US008905527B2

(12) United States Patent
Shirono et al.

(10) Patent No.: US 8,905,527 B2
(45) Date of Patent: Dec. 9, 2014

(54) LIQUID CARTRIDGE, LIQUID EJECTING DEVICE, METHOD OF MANUFACTURING LIQUID CARTRIDGE, AND METHOD OF REFURBISHING LIQUID CARTRIDGE

(75) Inventors: Taichi Shirono, Nagoya (JP); Noritsugu Ito, Tokoname (JP); Mikio Hirano, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 303 days.

(21) Appl. No.: 13/192,213

(22) Filed: Jul. 27, 2011

(65) Prior Publication Data

US 2012/0075392 A1 Mar. 29, 2012

(30) Foreign Application Priority Data

Sep. 2, 2010 (JP) ..... 2010-196341

(51) Int. Cl.
*B41J 2/175* (2006.01)
*B41J 29/393* (2006.01)
*B41J 2/17* (2006.01)

(52) U.S. Cl.
CPC ..... *B41J 2/17523* (2013.01); *B41J 2/17506* (2013.01); *B41J 2/17546* (2013.01)
USPC ..... 347/86; 347/19; 347/84; 347/85

(58) Field of Classification Search
USPC ..... 347/19, 84, 85, 86
See application file for complete search history.

(56) References Cited

U.S. PATENT DOCUMENTS

| | | | | |
|---|---|---|---|---|
| 6,973,409 | B1 | 12/2005 | Shimizu et al. | |
| 2007/0070146 | A1 | 3/2007 | Hattori et al. | |
| 2007/0236546 | A1* | 10/2007 | Sugahara | 347/86 |
| 2008/0198211 | A1 | 8/2008 | Aoki et al. | |
| 2008/0316249 | A1 | 12/2008 | Aoki et al. | |
| 2009/0153602 | A1 | 6/2009 | Brown et al. | |
| 2009/0322832 | A1 | 12/2009 | Wanibe et al. | |
| 2009/0322838 | A1 | 12/2009 | Wanibe et al. | |
| 2009/0322839 | A1 | 12/2009 | Ishizawa et al. | |

(Continued)

FOREIGN PATENT DOCUMENTS

| | | | |
|---|---|---|---|
| CN | 101249756 | A | 8/2008 |
| CN | 101612833 | A | 12/2009 |

(Continued)

OTHER PUBLICATIONS

European Patent Office, extended European Search Report for European Patent Application No. 11175660.7 (counterpart European patent application), dated Jul. 11, 2012.

(Continued)

*Primary Examiner* — Jannelle M Lebron
(74) *Attorney, Agent, or Firm* — Baker Botts L.L.P.

(57) ABSTRACT

A liquid cartridge includes a liquid storing portion that stores liquid therein, a liquid path that is in fluid communication with the liquid storing portion, a sealing member that is selectively penetrated and closed, and a storage. The storage includes a first count storage area configured to store first count data corresponding to a number of times the sealing member has been penetrated at a first position, and a first position sealing data corresponding to a first number that is comparable to the first count data.

21 Claims, 29 Drawing Sheets

(56) References Cited

U.S. PATENT DOCUMENTS

| | | | |
|---|---|---|---|
| 2010/0073438 | A1 | 3/2010 | Wanibe et al. |
| 2011/0242233 | A1 | 10/2011 | Hirano et al. |
| 2012/0069068 | A1 | 3/2012 | Ito et al. |
| 2013/0027480 | A1 | 1/2013 | Otobe |

FOREIGN PATENT DOCUMENTS

| | | | |
|---|---|---|---|
| EP | 1790480 | A1 | 5/2007 |
| JP | 2006-062282 | A | 3/2006 |
| JP | 2006-192792 | A | 7/2006 |
| JP | 2010-069807 | A | 4/2010 |

OTHER PUBLICATIONS

International Searching Authority, International Search Report and Written Opinion for International Patent Application No. PCT/JP2011/067822 (counterpart PCT application), mailed Nov. 1, 2011.

State Intellectual Property Office of the People's Republic of China, Notification of First Office Action for Chinese Patent Application No. 201110220951.6 (related to above-captioned patent application), mailed Oct. 8, 2013.

State Intellectual Property Office of the People's Republic of China, Notification of Second Office Action for Chinese Patent Application No. 201110220951.6 (related to above-captioned patent application), mailed May 22, 2014.

* cited by examiner

<INFORMATION STORED IN MEMROY OF INK CARTRIDGE>

| MAXIMUM INSERTION NUMBER | INSERTION NUMBER |
|---|---|
| X | a |
| (ROM AREA) | (RAM AREA) |

Fig.12

<INFORMATION STORED IN MEMORY OF CARTRIDGE>

FIRST TABLE (RAM AREA)

| PRINTER ID | INSERTION NUMBER |
|---|---|
| ID1 | a |
| ID2 | |

SECOND TABLE (ROM AREA)

| NUMBER OF IDS | MAXIMUM INSERTION NUMBER |
|---|---|
| 1 | X |
| 2 | Y |
| 3 | ZERO |

Fig.15

<INFORMATION STORED IN MEMORY OF CARTRIDGE>

FIRST TABLE (RAM AREA)

| PRINTER ID | INSERTION NUMBER |
|---|---|
| ID1 | a |
| ID2 | b |

SECOND TABLE (ROM AREA)

| NUMBER OF IDS | MAXIMUM INSERTION NUMBER |
|---|---|
| 1 | X |
| 2 | Y |
| 3 | ZERO |

Fig.19

<INFORMATION STORED IN MEMORY(EEPROM) OF CARTRIDGE>

| | |
|---|---|
| PRINTER ID | ID1 |
| PRINTER ID | ID2 |
| PRINTER ID | ID3 |
| INSERTION NUMBER ASSOCIATED WITH ID1 | a |
| INSERTION NUMBER ASSOCIATED WITH ID2 | b |
| INSERTION NUMBER ASSOCIATED WITH ID3 | c |
| MAXIMUM INSERTION NUMBER WHEN ID NUMBER IS 1 | X |
| MAXIMUM INSERTION NUMBER WHEN ID NUMBER IS 2 | Y |
| MAXIMUM INSERTION NUMBER WHEN ID NUMBER IS 3 | Z |

Fig.20

<INFORMATION STORED IN MEMORY(EEPROM) OF CARTRIDGE>

| | |
|---|---|
| PRINTER ID | ID1 |
| PRINTER ID | ID2 |
| PRINTER ID | ID3 |
| INSERTION NUMBER ASSOCIATED WITH ID1 | a |
| INSERTION NUMBER ASSOCIATED WITH ID2 | b |
| INSERTION NUMBER ASSOCIATED WITH ID3 | c |
| MAXIMUM INSERTION NUMBER WHEN ID NUMBER IS 1 | X |
| MAXIMUM INSERTION NUMBER WHEN ID NUMBER IS 2 | Y |
| MAXIMUM INSERTION NUMBER WHEN ID NUMBER IS 3 | Z |
| TOTAL NUMBER OF PRINTER IDS | 3 |

Fig.28

LIQUID CARTRIDGE, LIQUID EJECTING DEVICE, METHOD OF MANUFACTURING LIQUID CARTRIDGE, AND METHOD OF REFURBISHING LIQUID CARTRIDGE

CROSS REFERENCE TO RELATED APPLICATION

This application claims priority to and the benefit of Japanese Patent Application No. 2010-196341, filed Sep. 2, 2010, the entire disclosure of which are incorporated herein by reference.

BACKGROUND OF THE INVENTION

1. Field of the Invention

The invention relates to a liquid cartridge storing liquid such as ink, a liquid ejecting device including the liquid cartridge and a main body, a method of manufacturing a liquid cartridge, and a method of refurbishing a liquid cartridge.

2. Description of Related Art

A known liquid cartridge, such as an ink cartridge, includes a non-volatile memory in which the number of times the liquid cartridge was inserted to and removed from a liquid ejecting device is stored as a guideline for replacement of the liquid cartridge.

SUMMARY OF THE INVENTION

It may be considered to store the maximum number of times a liquid cartridge is inserted to and removed from a liquid ejecting device, in a memory of the liquid ejecting device. When the liquid ejecting device finds that, based on information regarding the maximum number of times, the number of times the liquid cartridge was inserted and removed exceeds the maximum number of times, the liquid ejecting device may perform an error notification to reduce the potential of liquid leakage from the liquid cartridge.

Nevertheless, the liquid cartridges may vary in terms of durability of insertion and removal and thus the maximum number of times for insertion and removal may vary depending on a characteristic of the liquid cartridges. Thus, in a known liquid ejecting device, when replacing the known liquid cartridge with another known liquid cartridge, the user has to do troublesome operation, e.g., revise the information regarding the maximum number of times stored in the liquid ejecting device.

Therefore, a need has arisen for a liquid cartridge, a liquid ejecting device, a method for manufacturing the liquid cartridge, and a method for refurbishing the liquid cartridge, which methods are designed to reduce the potential of liquid leakage from the liquid cartridge.

According to an aspect of the invention, a liquid cartridge comprises a liquid storing portion configured to store liquid therein, a liquid path configured to be in fluid communication with the liquid storing portion, a sealing member configured to selectively be penetrated and closed, and a storage. The storage comprises a first count storage area configured to store first count data corresponding to a number of times the sealing member has been penetrated at a first position and a first position sealing data corresponding to a first number that is comparable to the first count data.

According to another aspect of the invention, a liquid cartridge comprises a liquid storing portion configured to store liquid therein, a liquid path configured to be in fluid communication with the liquid storing portion, a sealing member configured to selectively be penetrated and closed, and a storage. The storage comprises first position sealing data corresponding to a first number that is comparable to a number of times that the sealing member is penetrated at a first position only.

According to another aspect of the invention, a liquid cartridge comprises a liquid storing portion configured to store liquid therein, a liquid path configured to be in fluid communication with the liquid storing portion, a sealing member configured to selectively be penetrated and closed, and a storage. The storage comprises a first count area configured to store data corresponding to a number of times the sealing member has been penetrated at a first position and a second count area configured to store data corresponding to a number of times the sealing member has been penetrated at a second position when the sealing member has been penetrated at each of the first position and the second position.

According to another aspect of the invention, a liquid cartridge comprises a liquid storing portion configured to store liquid therein, a liquid path configured to be in fluid communication with the liquid storing portion, a sealing member configured to receive a particular object therethrough, and a storage. The storage comprises a first count storage area configured to store first count data corresponding to a number of times the sealing member has received the particular object, and a particular object area configured to store particular object data corresponding to the particular object.

According to another aspect of the invention, a liquid cartridge comprises a liquid storing portion configured to store liquid therein, a liquid path configured to be in fluid communication with the liquid storing portion, a sealing member configured to selectively be penetrated and closed, and a storage. The storage comprises a liquid ejecting device number data corresponding to a total object number that is configured to be incremented each time the sealing member is penetrated by a unique object.

According to another aspect of the invention, a liquid cartridge comprises a liquid storing portion configured to store liquid therein, a liquid path configured to be in fluid communication with the liquid storing portion, a sealing member configured to selectively be penetrated and closed, and a storage. The storage comprises a liquid ejecting device number data, from which the number of liquid ejecting devices in which the sealing member has been penetrated, can be derived.

According to another aspect of the invention, a liquid ejection device comprises a liquid cartridge and a main body. The main body comprises a receiving portion configured to removably receive the liquid cartridge and a particular object configured to selectively penetrate a sealing member of the liquid cartridge. The liquid cartridge comprises a liquid storing portion configured to store liquid therein, a liquid path configured to be in fluid communication with the liquid storing portion, the sealing member, and a storage. The storage comprises a particular count storage area configured to store particular count data corresponding to a number of times the sealing member has been penetrated by the particular object, and a particular sealing data corresponding to a first number that is compared to the particular count data.

According to another aspect of the invention, a method of manufacturing a liquid cartridge having a liquid path attached to a liquid storing portion comprises attaching a sealing member to the liquid cartridge in the liquid path, and writing a particular sealing data into a storage, the particular sealing data corresponding to a maximum number of times the sealing member may be allowed to be penetrated by a particular object. The maximum number of times is at least partially related to a specification of the sealing member.

According to another aspect of the invention, a method of refurbishing a liquid cartridge having a liquid path attached to a liquid storing portion and comprising a sealing member disposed in the liquid path comprises replacing the sealing member with a new sealing member, and writing a particular sealing data into a storage, the particular sealing data corresponding to a maximum number of times the new sealing member may be allowed to be penetrated by a particular object. The maximum number of times is at least partially related to a specification of the new sealing member.

In an embodiment of the invention, as the cartridge memory stores the maximum insertion number information, there is no need for the user to perform a troublesome operation, e.g., revise the maximum insertion number information stored in the liquid ejecting device. Thus, without the need to perform this troublesome operation on the liquid cartridge, the potential of causing or facilitating liquid leakage from the liquid cartridge may be reduced.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

FIG. 12 is an illustration representing the information stored in the memory of the liquid cartridge, according to an embodiment of the invention.

FIG. 15 illustrates information stored in the memory of the liquid cartridge according to the yet another embodiment of the invention.

FIG. 19 illustrates an example of information stored in the memory of the liquid cartridge mounted in the printer according to the further embodiment of the invention.

FIG. 20 illustrates another example of information stored in the memory of the liquid cartridge mounted in the printer according to the further embodiment of the invention.

FIG. 28 illustrates another example of information stored in the memory of the liquid cartridge mounted in the printer according to a modified further embodiment of the invention.

DETAILED DESCRIPTION OF THE INVENTION

Embodiments of the invention and their features and technical advantages may be understood by referring to FIGS. 1-29, like numerals being used for like corresponding portions in the various drawings.

Figure 1:
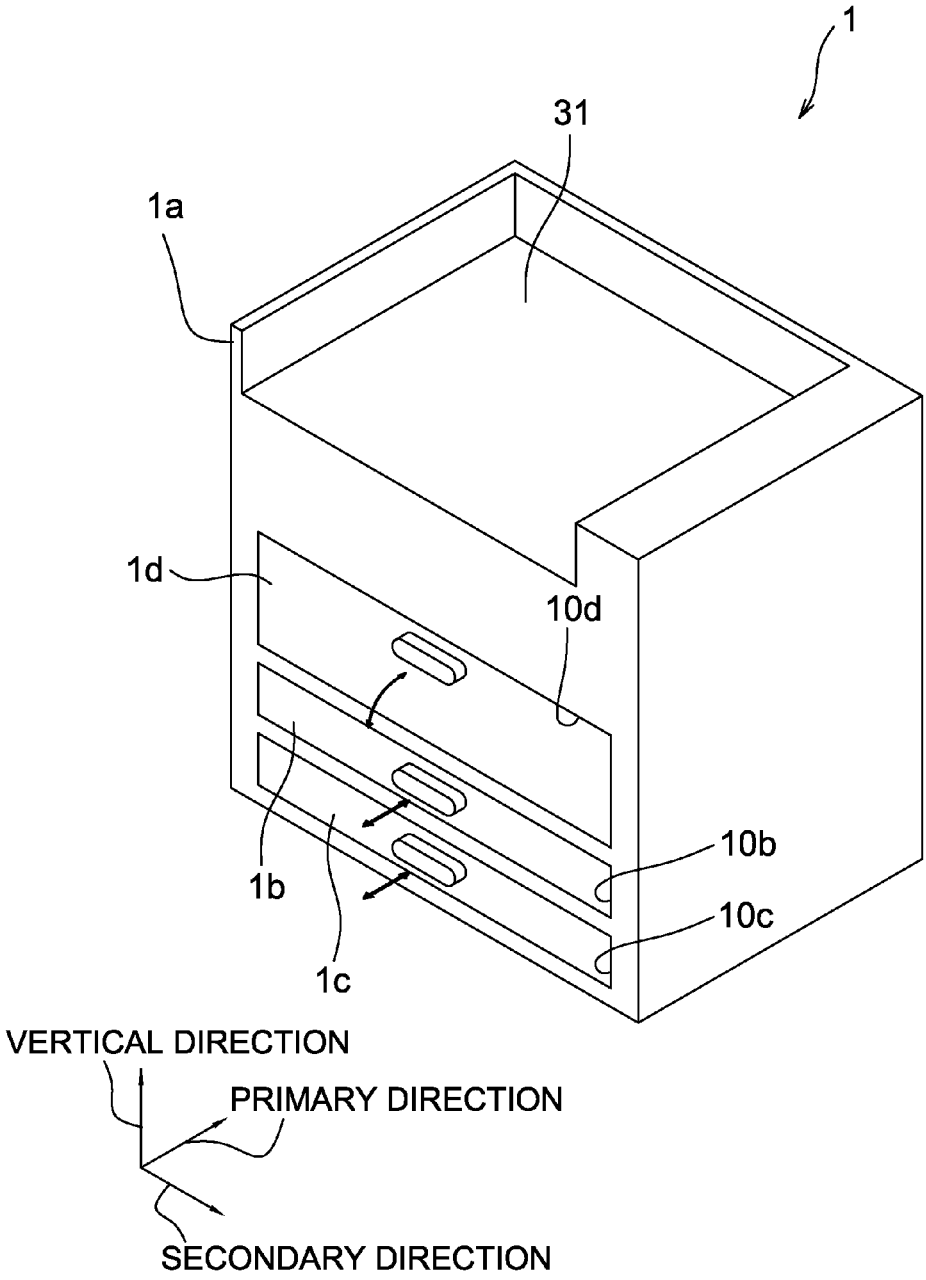
FIG. 1 is a perspective view of an inkjet printer comprising a liquid cartridge, according to an embodiment of the invention.
Figure 2:
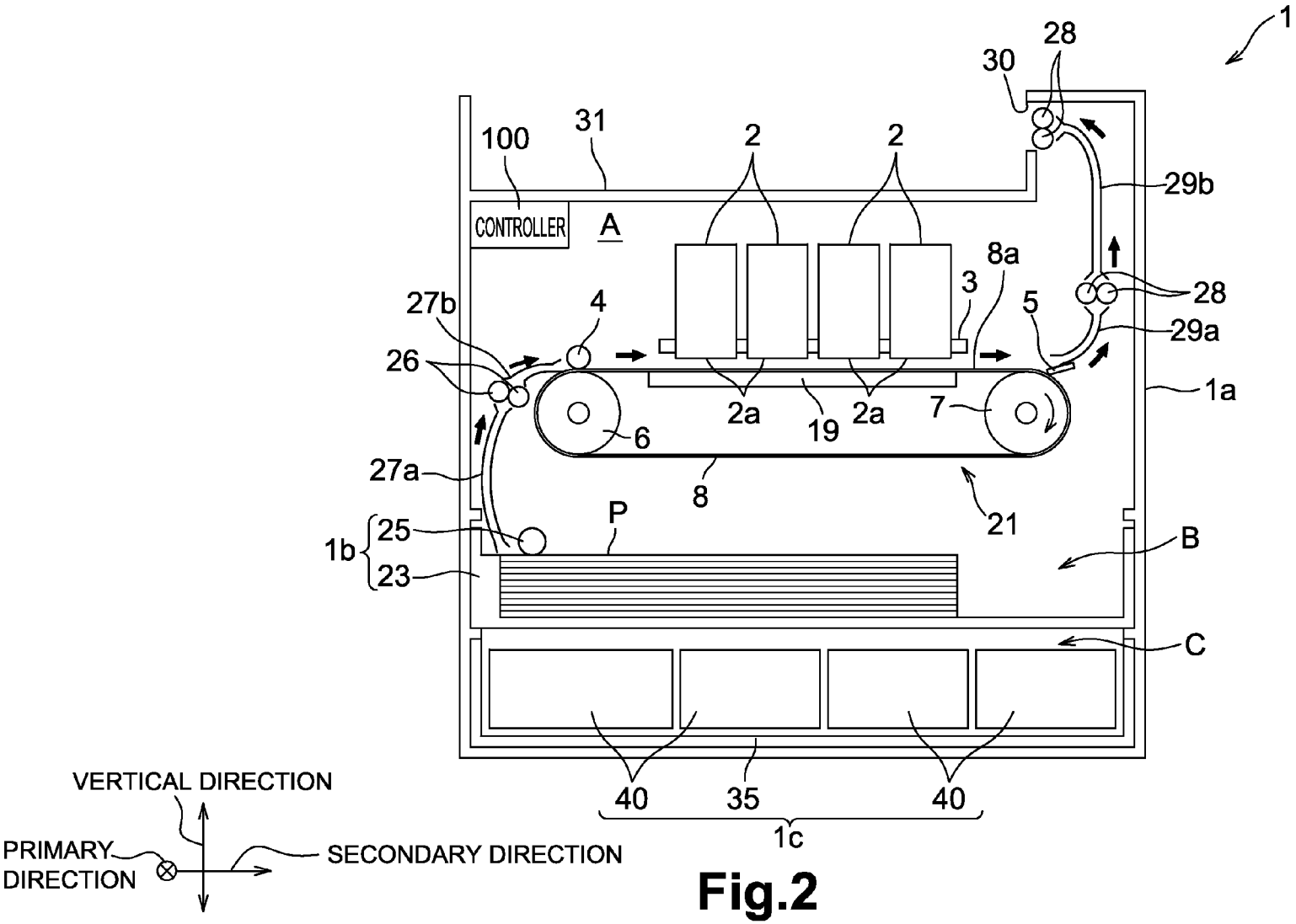
FIG. 2 is a schematic side view of the internal structure of the inkjet printer, according to an embodiment of the invention.

FIG. 1 describes a general structure of a liquid ejecting device, e.g., an ink jet printer 1, according to an embodiment of the invention. The printer 1 may comprise a main unit and one or more liquid cartridges 40 configured to be mounted to the main unit. The main unit of the printer 1 may comprise a housing 1*a* having substantially a rectangular parallelepiped shape. A sheet discharge portion 31 may be disposed at the top of the housing 1*a*. The housing 1*a* may have three openings 10*d*, 10*b*, and 10*c* formed in one of its vertically extending outer faces, e.g., a front face of the liquid ejecting device. The openings 10*d*, 10*b*, and 10*c* may be vertically aligned in this order from higher to lower when the liquid ejecting device is oriented vertically as shown in FIG. 1. A sheet feed unit 1*b* and an ink unit 1*c* may be removably inserted into the housing 1*a* though the openings 10*b* and 10*c*, respectively. The printer 1 may comprise a door 1*d* fitted into the opening 10*d* and configured to pivot about a horizontal axis at a lower end of door 1*d*. When the door 1*d* is pivoted to be opened and closed, the opening 10*d* may be covered and uncovered, respectively. As shown in FIG. 2, the door 1*d* may be disposed with an interior surface facing a transporting unit 21 interior to the liquid ejecting device in a primary direction.

FIG. 2 shows a general interior structure of the printer 1, according to an embodiment of the invention. The interior of the housing 1*a* may be divided into spaces A, B, and C in the vertical direction in this order from above to below, as shown in FIG. 2. A plurality of, e.g., four, ink jet heads 2, the transporting unit 21, and a controller 100 may be disposed within the space A. The four ink jet heads 2 may be configured to discharge inks of magenta, cyan, yellow, and black, respectively, although in other embodiments, the ink jet heads 2 may be configured to eject other color inks, or other types of liquids, e.g., water, or The transporting unit 21 may be configured to transport sheets P. The controller 100 may be configured to control operations of the components of the printer 1.

The sheet feed unit 1*b* may be disposed in the space B, and the ink unit 1*c* may be disposed in the space C. A sheet transport path, along which sheets P may be transported, may be formed in the housing 1*a*. The sheet transport path may extend from the sheet feed unit 1*b* toward the sheet discharge portion 31, as shown by the bold arrows in FIG. 2.

Figure 4:
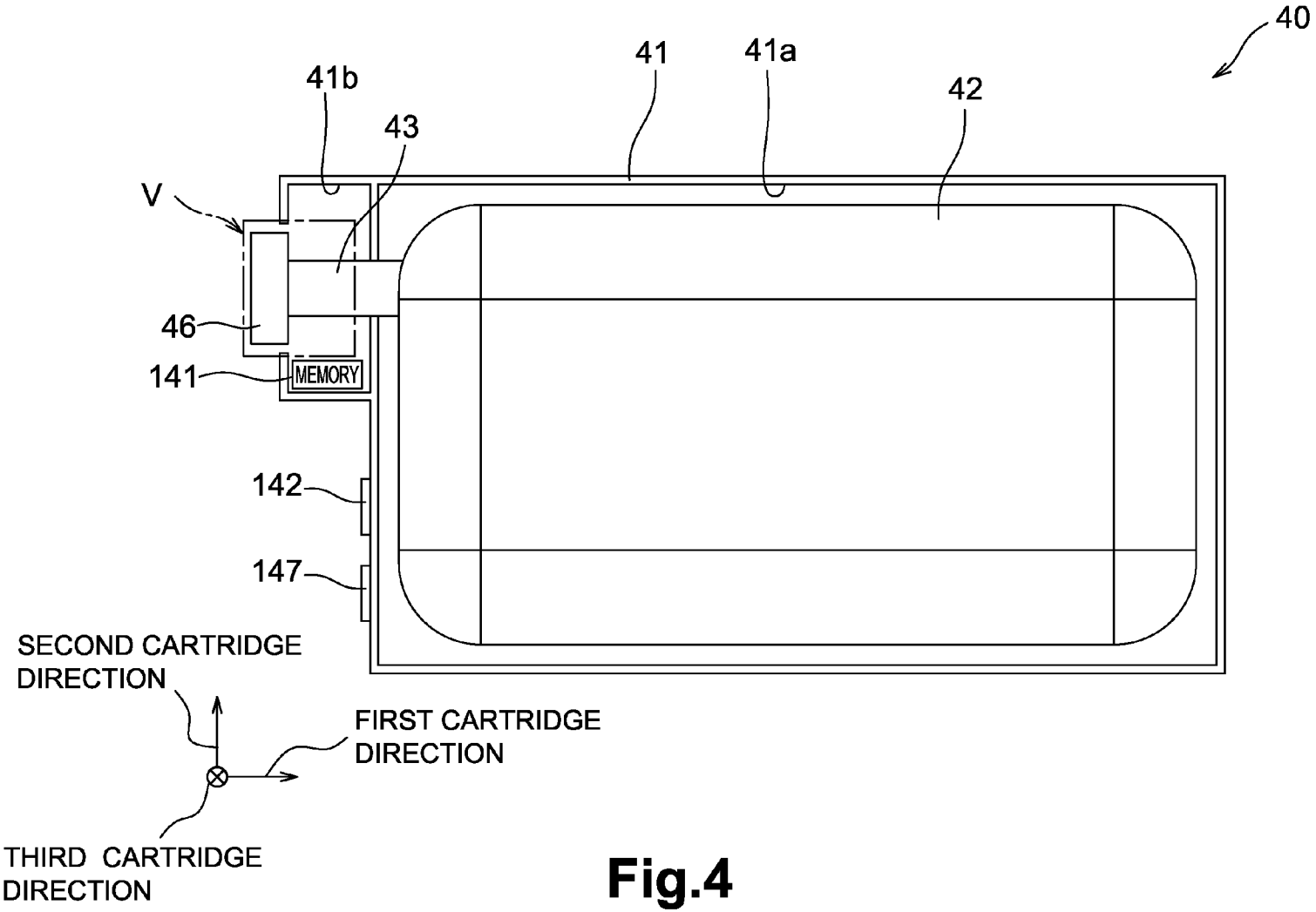
FIG. 4 schematically illustrates the internal structure of the liquid cartridge, according to an embodiment of the invention.

The controller 100 may comprise a central processing unit (CPU), a read only memory (ROM), a random access memory (RAM) such as a nonvolatile RAM, and an interface. The ROM may store programs to be executed by the CPU, and various fixed data. The fixed data may comprise a printer ID, which may be assigned to the printer as its unique label. The printer can be distinguished from other printers by reading its printer ID. In an embodiment of the invention, the printer ID may reveal other information regarding the characteristics of the printer. The RAM may temporarily store data, e.g., image data, which the CPU may use to execute programs. As shown in FIG. 4, a liquid cartridge, e.g., liquid cartridge 40, may comprise a memory 141. The controller 100 may receive data from the liquid cartridge 40, may transmit and receive data to and from a sensor unit 70 and the memory 141 of the liquid cartridge 40, and may transmit and receive data to and from an external device, e.g., a personal computer connected to the printer 1.

Figure 8:
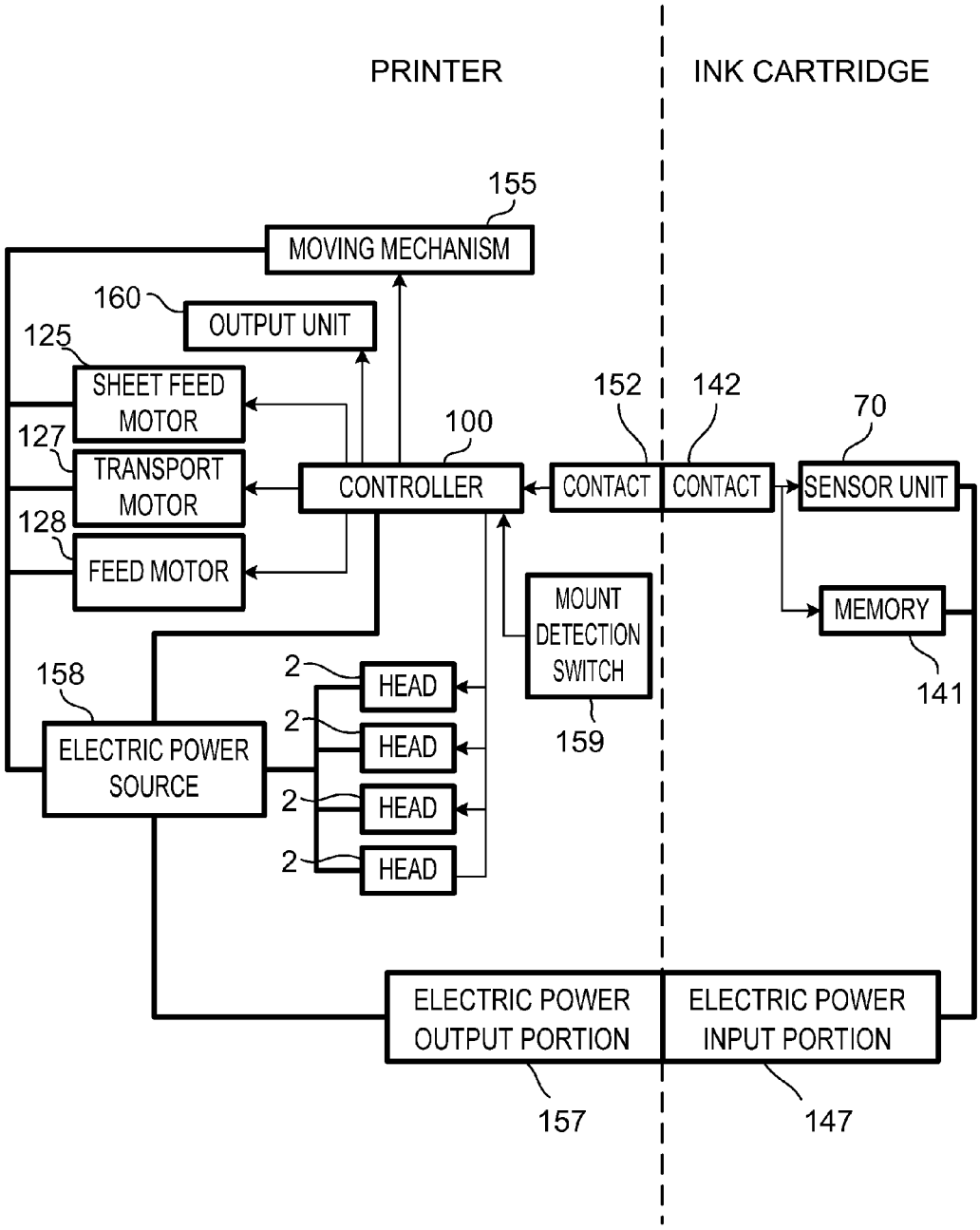
FIG. 8 is a block diagram illustrating an electrical configuration of the liquid cartridge and the printer, according to an embodiment of the invention.

Referring again to FIG. 2, the sheet feed unit 1*b* may comprise a sheet feed tray 23 and a sheet feed roller 25. The sheet feed tray 23 may be configured to be detachably attached to the housing 1*a* in the primary direction. The sheet fed tray 23 may have a substantially box shape, open upward. Sheet feed tray 23 may be configured to store sheets P of various sizes. As shown in FIG. 8, a sheet feed motor 125 that may be controlled by the controller 100, may drive the sheet feed roller 25, which may be configured to feed out the topmost sheet P in the sheet feed tray when driven by sheet feed roller 25. The sheet P fed out by the sheet feed roller 25 may be sent to the transporting unit 21 while being guided by guides 27*a* and 27*b* and while being nipped by a pair of feed rollers 26.

The transport unit 21 may comprise two belt rollers 6 and 7, and an endless transport belt 8 may be wound around the belt rollers 6 and 7. In an embodiment of the invention, the belt roller 7 may be a driving roller configured to rotate in the clockwise direction when the printer is oriented as shown in FIG. 2. Specifically, referring to FIG. 8, when a shaft of the belt roller 7 is driven by a transport motor 127 controlled by the controller 100, the belt roller 7 may receive a driving force from the transport motor 127. Referring again to FIG. 2, The belt roller 6 may be a driven roller configured to rotate in the clockwise direction when the printer is oriented as shown in FIG. 2, along with the running of the transport belt 8 caused by the rotation of the belt roller 7.

A platen 19 having a substantially rectangular parallelepiped shape may be disposed within the loop of the transport belt 8. An outer surface 8*a* of the transport belt 8 at an upper portion of the loop may face lower surfaces 2*a* of the ink jet heads 2, and may extend substantially in parallel with the lower surfaces 2*a* with a slight gap formed between the lower surfaces 2*a* and the outer surface 8*a*. The platen 19 may support an inner surface of the transport belt 8 at the upper portion of the loop 8. The lower surface 2*a* of each ink jet head 2 may be a discharge surface where a plurality of discharge nozzles for discharging ink may be formed.

A silicone layer having a low adhesive property may be formed on the outer surface 8*a* of the transport belt 8. The sheet P that is fed out from the sheet feed unit 1*b* toward the transport unit 21 may be pressed by a pressing roller 4 against the outer surface 8*a* of the transport belt 8. While being held on the outer surface 8*a* by the adhesive property of outer surface 8*a*, the sheet P may be transported in a secondary direction as shown by the bold arrows in FIG. 2.

The secondary direction may be substantially parallel with a transporting direction in which the transporting unit 21 transports the sheet P. The primary direction is a direction substantially perpendicular to the secondary direction. As shown in FIG. 2, each of the primary direction and the secondary direction is a horizontal direction with respect to the image forming device.

When the sheet P held on the outer surface 8*a* of the transport belt 8 passes immediately below the four ink jet heads 2, the ink jet heads 2 discharge inks of respective colors from the lower surfaces 2*a* sequentially, thereby forming an image, e.g., a color image, on the sheet P. A separating plate 5 may be configured to separate the sheet P from the outer surface 8*a* of the transport belt 8 when the sheet P is fed to the separating plate 5. The sheet P may be transported upward while being guided by guides 29*a*, 29*b* and while being nipped by two pairs of transport rollers 28, and may be discharged through an opening 30 formed at the top of the housing 1*a* onto the sheet discharge portion 31. Referring to FIG. 8, one roller of each transport roller pair 28 may be driven by a feed motor 128 controlled by the controller 100.

Referring again to FIG. 2, the head 2 may be a line-type head that is elongated in the primary direction and has substantially a rectangular parallelepiped shape. The four heads 2 may be arranged having a predetermined pitch in the secondary direction and may be supported by the housing 1*a* via a frame 3. A joint may be disposed at an upper surface of each head 2, and may receive a flexible tube (not shown). A plurality of discharge nozzles (not shown) may be formed in the lower surface of each head 2. An ink path may be formed inside each head 2 such that ink supplied from a corresponding liquid cartridge 40, via a corresponding tube and a corresponding joint, may flow to corresponding discharge nozzles.

The ink unit 1*c* may comprise a cartridge tray 35, and a plurality of, e.g., four liquid cartridges 40 removably disposed in the liquid cartridge tray 35. The liquid cartridge 40 at the leftmost position in FIG. 2 may store black ink, and may have a greater size in the secondary direction and a greater ink capacity than the other three liquid cartridges 40. The other three liquid cartridges 40 may have substantially the same ink capacity, and may store magenta, cyan, and yellow ink, respectively. The ink stored in each liquid cartridge 40 may be supplied to a corresponding head 2 via a corresponding tube (not shown) and a corresponding joint (not shown). The liquid cartridge tray 35 may be detachably attached to the housing 1*a* in the primary direction in a state where the liquid cartridges 40 are disposed in the liquid cartridge tray 35. Accordingly, the liquid cartridges 40 in the liquid cartridge tray 35 may be selectively replaced in a state in which the liquid cartridge tray 35 is detached from the housing 1*a*.

FIGS. 3-6 illustrate a structure of the liquid cartridge 40 according to an embodiment of the invention. The four liquid cartridges 40 to be disposed in the liquid cartridge tray 35 may have the same structure, except that in an embodiment of the invention, a black ink cartridge has a greater size in the secondary direction and a greater ink capacity than the other three liquid cartridges.

Figure 3:
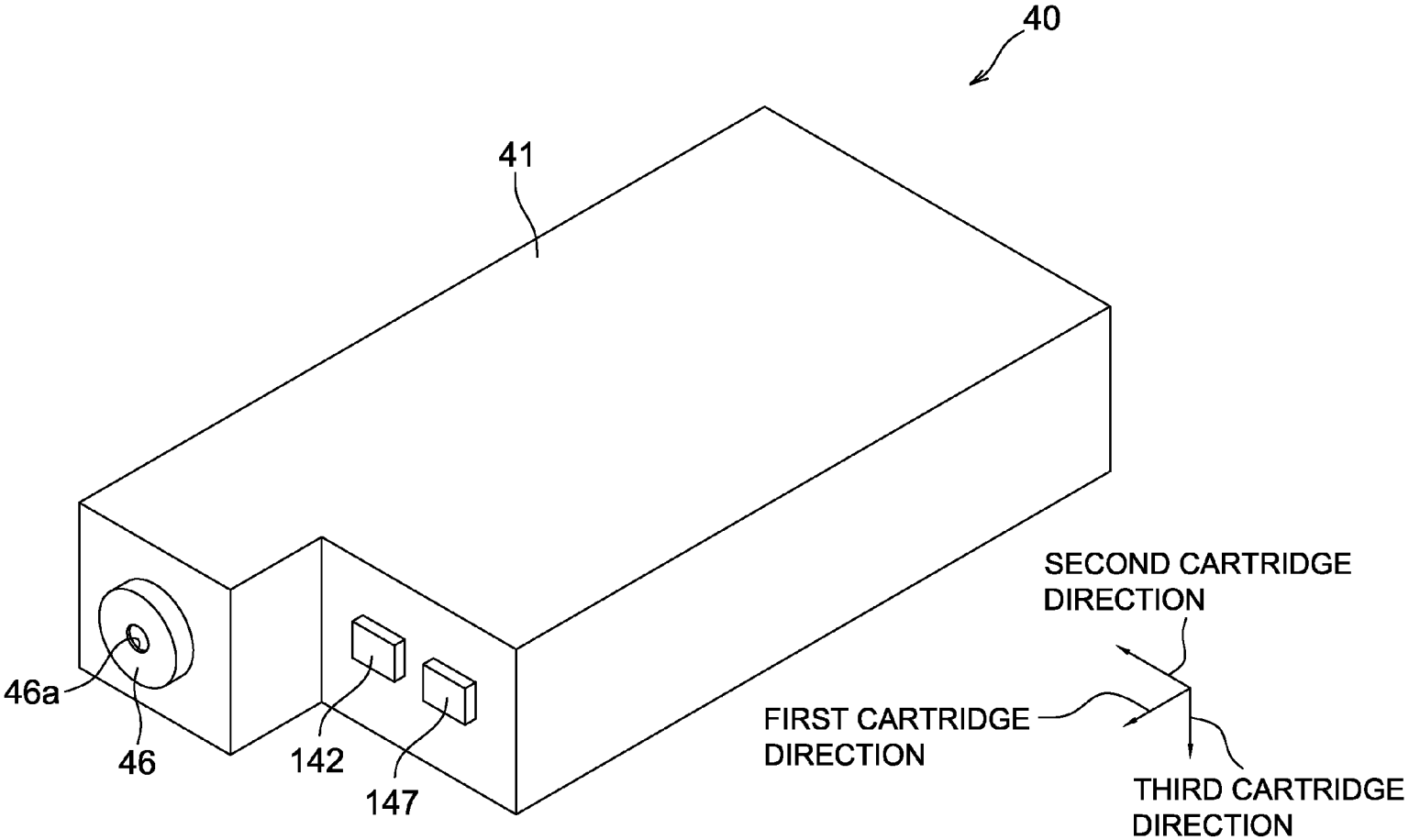
FIG. 3 is a perspective view of a liquid cartridge, according to an embodiment of the invention.

Each liquid cartridge 40 may comprise a housing 41, a liquid storing portion, e.g., reservoir 42, an ink outlet tube 43, a sealing member, e.g., plug 50, a valve 60, the sensor unit 70, the memory 141, a contact 142, and an electric power input portion 147. As shown in FIG. 3, the housing 41 has a substantially rectangular parallelepiped shape. In an embodiment of the invention, the dimension of the housing 41 in a first cartridge direction, i.e., the length, is greater than the dimension of the housing 41 in a second cartridge direction, i.e., the width, and the width dimension of the housing 41 in the second cartridge direction is greater than the dimension of the housing in a third cartridge direction, i.e., the height. The first cartridge direction, the second cartridge direction, and the third cartridge direction are each perpendicular to the other two directions. When the liquid cartridge 40 is mounted in the liquid cartridge tray 35 of the printer 1, the first cartridge dimension may be aligned with the primary direction, the second cartridge direction may be aligned with the secondary direction, and the third cartridge direction may be aligned with the vertical direction.

Referring to FIG. 4, the interior of the housing 41 may be divided into at least two chambers 41*a* and 41*b* in the first cartridge direction. The reservoir 42 may be disposed in the first chamber, e.g., the right chamber 41*a*, and the ink outlet tube 43 may be disposed in the second chamber, e.g., the left chamber, e.g., the other chamber 41*b*. The reservoir 42 may be a collapsible bag-shaped member that stores liquid, e.g., ink, therein and which may be disposed in the housing 41. The reservoir 42 may have an opening to which one end of the ink outlet tube 43 may be connected. The ink outlet tube 43 may define a liquid path, e.g., an ink outlet path 43*a* for discharging the ink stored in the reservoir 42 to the head 2.

Figure 5A:
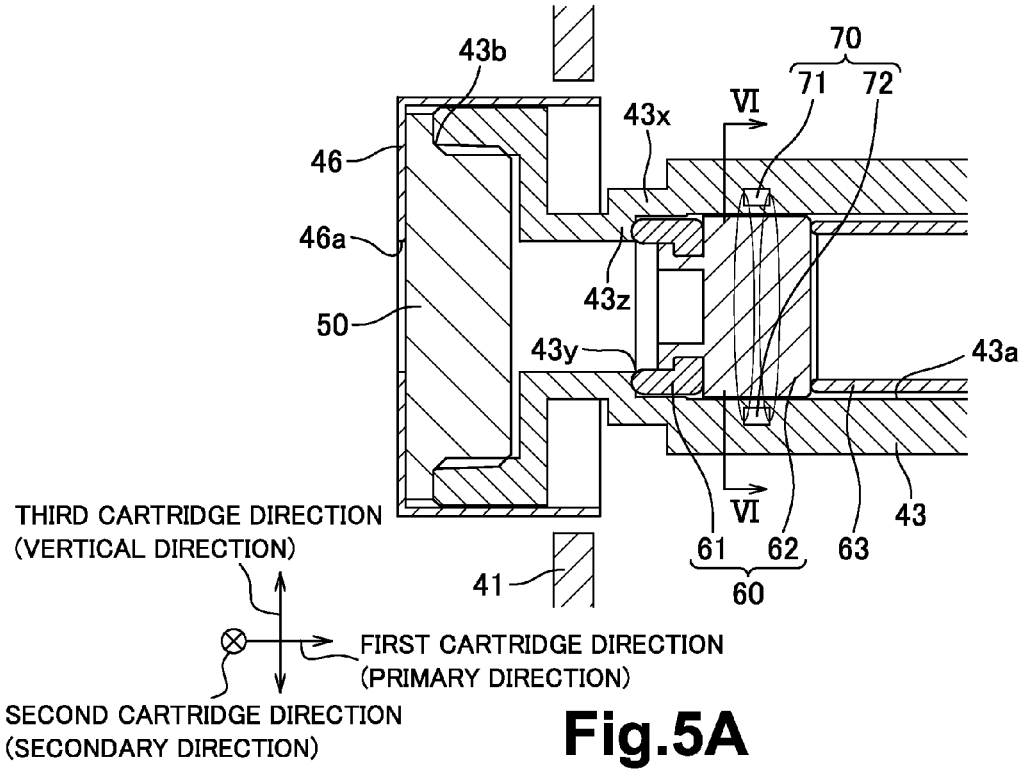
FIG. 5A is a partial cross sectional view of the liquid cartridge when a hollow tube of the printer is not inserted into a plug of the liquid cartridge and a valve is in a closed position, according to an embodiment of the invention.

As shown in FIG. 4, the other end of the ink output tube 43 opposite to the reservoir 42 may protrude from the housing 41 of the cartridge 40. The ink outlet tube 43 may have an opening 43*b* at a side opposite to the reservoir 42. The plug 50 may comprise an elastic material, e.g., rubber, and may be disposed in a compressed state at the end of the ink outlet tube 43 such that the plug 50 closes the opening 43*b* of the ink outlet path 43*a*, as shown in FIG. 5A. Referring again to FIG. 4, a cap 46 may be disposed at the other end of the ink outlet tube 43 and outside the plug 50. The cap 46 may have an opening 46*a* formed therethrough substantially at its center. A surface, which may be an opposite side of a surface facing the valve 60, of the plug 50 may be partially exposed through the opening 46*a*.

Figure 5B:
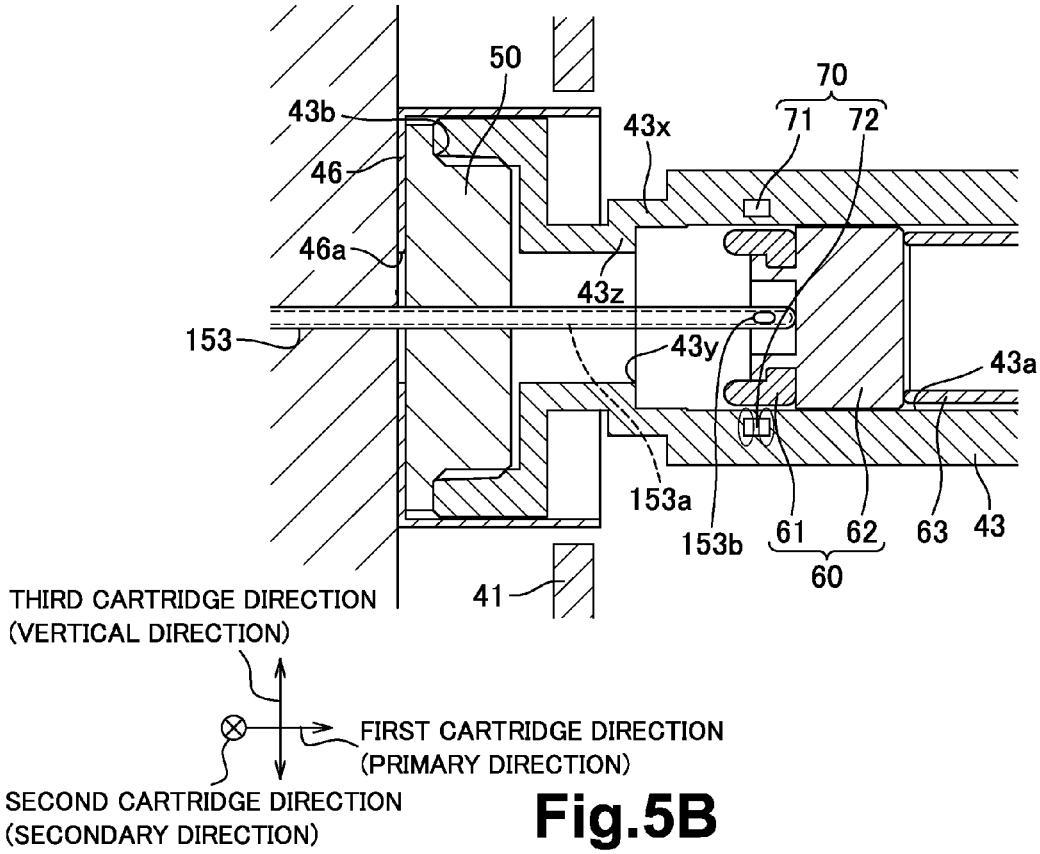
FIG. 5B is a partial cross sectional view of the liquid cartridge when the hollow tube of the printer is inserted into the plug of the liquid cartridge and the valve is in an open position, according to an embodiment of the invention.
Figure 6:
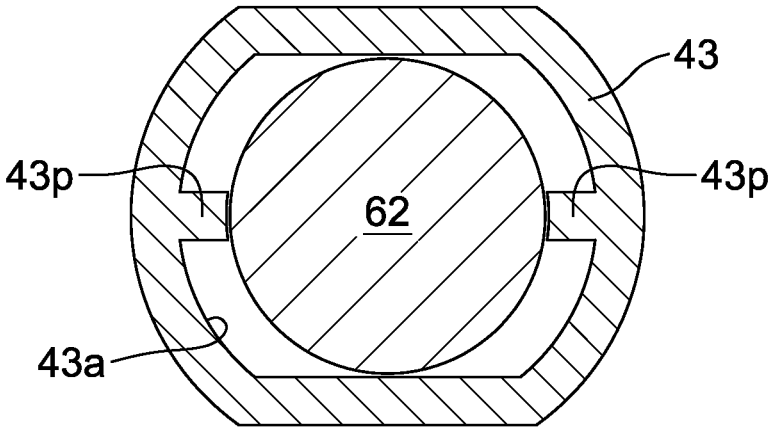
FIG. 6 is a partial cross sectional view taken along a line VI-VI of FIG. 5A.

As shown in FIGS. 5A and 5B, the valve 60 may be disposed in the ink outlet path 43*a*, and may comprise an O ring 61 and a valve body 62. As shown in FIGS. 5A, 5B and 6, the valve body 62 may be a cylindrical-shaped magnetic body having an axis extending in the first cartridge direction. As shown in FIG. 6, the ink outlet tube 43 may have a substantially cylindrical-shape. The valve body 62 may be disposed within a portion of the ink outlet tube 43. The portion of the ink outlet tube 43 may comprise substantially flat top and bottom walls and curved side walls. The portion of the ink outlet tube 43 may be elongated in the second cartridge direction in cross section which extends in a direction perpendicular to the first cartridge direction. A plurality of protrusions 43*p* may be disposed at inner surfaces of the respective side walls of the ink outlet tube 43 in the second cartridge direction so as to protrude toward the inside of the ink outlet tube 43.

Each protrusion 43*p* extends along the first cartridge direction within the area of ink outlet tube 43 in which the valve body 62 may be movable through. The valve body 62 may be held by the protrusions 43*p* and the top and bottom walls of the ink outlet tube 43 such that the valve body 62 may be positioned substantially at the center of the ink outlet path 43*a* when viewed in a cross-sectional view. A flow path may be defined by a gap between the valve body 62 and the ink outlet tube 43 at a portion where the valve body 62, the protrusions 43*p* and the top and bottom walls of the ink outlet tube 43 are separated from each other and do not contact with each other.

The O-ring 61 may comprise an elastic material, e.g., rubber. The O-ring 61 may be fixed to a surface of the valve body 62 facing the plug 50. A coil spring 63 may urge the valve 60 toward an opening 43*y*. The coil spring 63 may have a first end that is fixed to one end of the ink outlet tube 43, and a second end opposite to the first end that is in contact with the other surface of the valve body 62.

As shown in FIG. 5A, the ink outlet tube 43 may comprise a valve seat 43*z* that protrudes toward the center of the diameter of the ink outlet tube 43 from one end, e.g., the end provided near the opening 43*b* of a narrowed portion 43*x*. When the valve 60 is in a closed position where the valve 60 closes the ink outlet path 43*a*, the O ring 61 may be in contact with valve seat 43*z*. When O ring 61 is in contact with valve seat 43*z*, the opening 43*y* at one end of the narrow portion 43*x* may be blocked. When the opening 43*y* is blocked, fluid communication between the reservoir 42 and the outside of the liquid cartridge 40 via the ink outlet path 43*a* also may be blocked. At this time, the urging force of the coil spring 63 may elastically deform the O ring 61.

The sensor unit 70 includes a Hall device 71 and a magnet 72. The magnet 72 produces a magnetic field. The Hall device 71 may comprise a magnetic sensor that detects a magnetic field of the magnet 72, converts the detected magnetic field into an electrical signal and outputs the electrical signal to the controller 100 via the contact 142. In an embodiment, the Hall device 71 may be configured to output a signal indicating a voltage proportional to the magnitude of a magnetic field. The magnitude of the magnetic field may vary in accordance with the movement of the valve body 62, to the controller 100. As shown in FIG. 5A, the Hall device 71 may be disposed where the Hall device 71 is configured to detect the magnetic field produced by the magnet 72 and the valve body 62. As shown in FIG. 5A, the Hall device 71 and the magnet 72 may be fixed to the top wall and the bottom wall of the ink outlet tube 43, respectively, such that the Hall device 71 and magnet 72 may face each other in the third cartridge direction.

When the valve 60 is in the closed position, the Hall device 71 and the magnet 72 may face each other, with the valve body 62 positioned therebetween, e.g., the valve body 62 may be interposed between the Hall device 71 and the magnet 72 when the valve 60 is in the closed position. In the closed position state, the magnetic field produced by the magnet 72 may more efficiently reach the Hall device 71 via the valve body 62 due to the alignment of valve body 62 with the magnet 72 in the third cartridge direction. Accordingly, when the valve 60 is in the closed position, the Hall device 71 may detect a high magnetic field magnitude and may output a signal indicating a high voltage.

While the valve 60 moves from the closed position shown in FIG. 5A to an open position shown in FIG. 5B where the ink outlet path 43*a* is open, the magnetic field strength detected by the Hall device 71 may be lower in accordance with the movement of the valve body 62 to the position where the valve body 62 does not face the Hall device 71 and the magnet 72 in the vertical direction, i.e., the valve body 62 is not positioned directly between the Hall device 71 and the magnet 72. Thus, the voltage indicated by a signal outputted from the Hall device 71 may become lower. The controller 100 may determine whether the valve 60 is in the open position or closed position based on the voltage indicated by the signal received from the Hall device 71.

During the course of operation, the liquid cartridge 40 may be mounted in a printer and then removed therefrom. After that, the liquid cartridge 40 may be mounted in the same printer again or mounted in another printer. For example, in an example, assume that there are two printers, a first printer 1 and a second printer 1, which are located away from each other. At the start, the liquid cartridge 40 may be mounted in the first printer 1. When the second printer 1 is used, the liquid cartridge 40 may be removed from the first printer 1 and mounted in the second printer 1. When the first printer 1 is used again, the liquid cartridge 40 may be removed from the second printer 1 and mounted in the first printer 1.

Each time the liquid cartridge 40 is mounted and removed from first printer 1 or second printer 1, the plug 50 elastically deforms. If the mounting and removing of the liquid cartridge 40 relative to one printer or among plural printers is frequently carried out, a significant load may be placed on the plug 50 of the liquid cartridge 40. When the number of times of the mounting and removing of the liquid cartridge 40 exceeds a predetermined number of times, a portion of the plug 50 of the liquid cartridge 40 may crack. Such a crack may form a hole from which ink may leak.

In an embodiment of the invention, memory 141 ma stores characteristic information that may reduce or prevent this situation from occurring. Referring to FIG. 12, the memory 141 may comprise a ROM area, e.g. EEPROM, and a RAM area. The characteristic information may comprise maximum insertion number information, which may be stored in the ROM area. In an embodiment of the invention, the insertion number information may be stored in the RAM area. The maximum insertion number information may comprise data, e.g., a first position sealing data, which may correspond to a first number. The first number may be a maximum number of times a hollow tube 153 may be inserted into the plug 50. The insertion number information may comprise data, e.g., first count data, which may correspond to the number of times the hollow tube 153 has been inserted into the plug 50.

In an example shown in FIG. 12, the memory 141 stores a number represented by "a" for the total number of times the hollow tube 153 of the printer 1 has been inserted into the plug 50 of the liquid cartridge 40. This number may be stored as, and will hereinafter be interchangeably referred to as an insertion number, as the insertion number information. Memory 141 also may store a number represented by "X" for the maximum number of times the hollow tube 153 of the printer 1 may be inserted into the plug 50 of the liquid cartridge 40. This number may be stored as a first number, and will hereinafter be interchangeably referred to as a maximum insertion number, as the maximum insertion number information. The first number is comparable to, e.g., suitable for comparison with, the insertion number.

FIGS. 8-11 show steps for mounting the liquid cartridge 40 will be described. Referring to FIG. 8, electric power supply lines are shown in thick lines, and signal lines are shown in thin lines. Before the liquid cartridge 40 is mounted in the printer 1, as shown in FIG. 5A, the hollow tube 153 is not inserted into the plug 50, and the valve 60 may be maintained in the closed position. At this state, electrical connections shown in FIG. 8 between the contact 142 and a contact 152, and between the electric power input portion 147 and an electric power output portion 157, are not yet established. Thus, no signals are transmitted between the liquid cartridge 40 and the printer 1, and no electric power may be supplied to the sensor unit 70 and the memory 141 of the liquid cartridge 40.

Figure 7A:
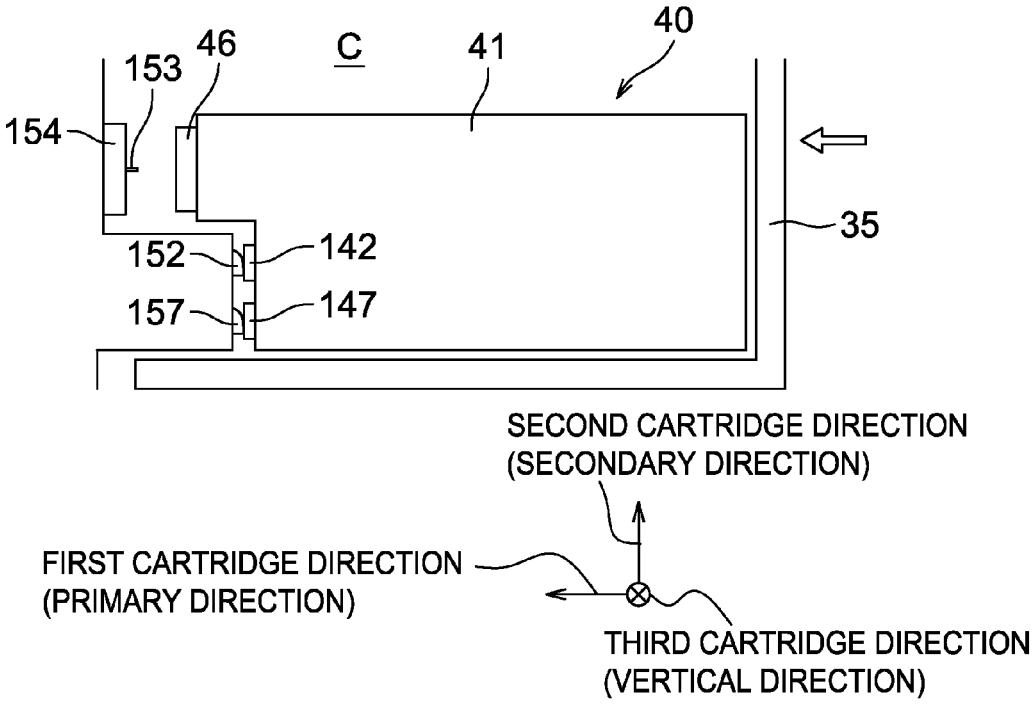
FIGS. 7A and 7B are schematic plan views illustrating a sequential process by which the liquid cartridge is mounted to the printer, according to an embodiment of the invention.

In order to mount the liquid cartridge 40 to the printer 1, referring to FIG. 2, the liquid cartridge 40 may be placed together with other liquid cartridges 40 in the liquid cartridge tray 35 of the printer 1, and the liquid cartridge tray 35 may be inserted into the space C of the housing 1*a* in the primary direction, e.g., in the direction shown by an open arrow in FIG. 7A). Referring now to FIG. 7A, the contact 142 of the liquid cartridge 40 first makes contact with the contact 152 of the printer 1 to establish electric connection between the liquid cartridge 40 and the printer 1. This allows the liquid cartridge 40 and the printer 1 to transmit and receive signals therebetween. The contact 152 may be formed on a wall surface defining the space C in the housing 1*a* and may function as an interface of the controller 100.

As shown in FIG. 7A, at substantially the same time when the contact 142 makes contact with the contact 152, the electric power input portion 147 of the liquid cartridge 40 also may make contact with the electric power output portion 157 of the printer 1 to establish electric connection therebetween. Referring to FIG. 8, electric power may be supplied from the electric power source 158 via the electric power input portion 147 and the electric power output portion 157 to the sensor unit 70 and the memory 141 of the liquid cartridge 40.

Figure 7B:
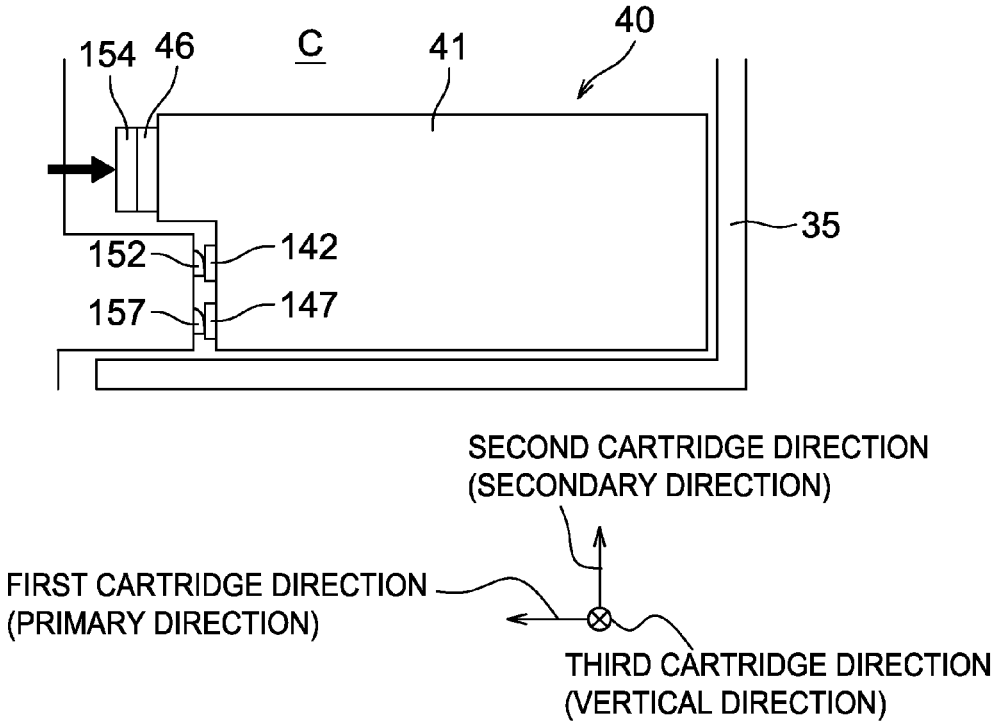

The electric power source 158 may be disposed in the housing 1*a* and may supply electric power to each component of the printer 1. The electric power output portion 157 may be electrically connected to the electric power source 158 and may be disposed on the wall surface defining the space C in the housing 1*a* at a position facing the electric input portion 147 of the liquid cartridge 40, as shown in FIGS. 7A and 7B. The electric power input portion 147 may be electrically connected to the sensor unit 70 and the memory 141, and may be disposed on an outer exposed surface of the housing 41 at a position adjacent to the contact 142. The contact 152 and the electric power output portion 157 may be provided for each of the liquid cartridges 40 that are placed on the liquid cartridge tray 35.

In a state shown in FIG. 7A, the liquid cartridge 40 may be separated from, e.g., spaced away from the hollow tube 153, and the reservoir 42 may not be in fluid communication with the ink path of the head 2. In other words, the hollow tube 153 may be located in the non-insertion position as shown in FIG. 7A, e.g., away from the plug 50 of the liquid cartridge 40 mounted in the space C. The hollow tube 153 may be fixed to a base portion 154 configured to move in the primary direction relative to the housing 1*a*. Hollow tube 153 may be in fluid communication with a tube attached to the joint of the head 2. The hollow tube 153 and the contact 152 may be provided for each of the liquid cartridges 40 placed in the liquid cartridge tray 35.

As shown in FIG. 8, the printer 1 may comprise a mount detection switch 159, that may be configured to detect that the liquid cartridge 40 has been mounted in a predetermined position in the space C, specifically at the position where the contact 142 contacts the contact 152 and where the electric power input portion 147 contacts the power output portion 157 as shown in FIG. 7A, in this embodiment. The mount detection switch 159 may be configured to send, to the controller 100, an ON signal when the printer 1 and the liquid cartridge 40 are electrically connected and an OFF signal when the printer 1 and the liquid cartridge 40 are not electrically connected.

Figure 11:
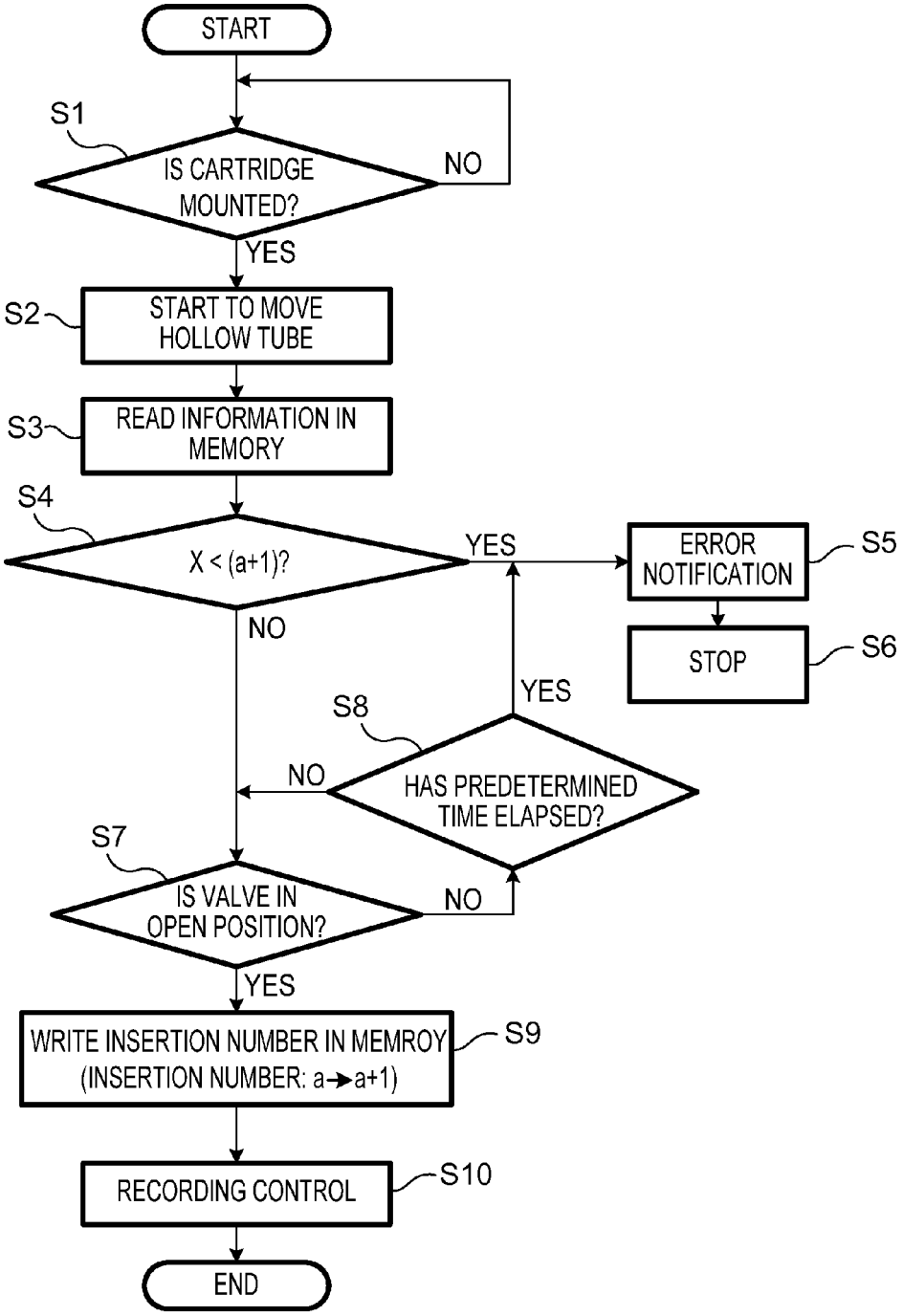
FIG. 11 is a flow chart illustrating steps performed by the controller of the printer when the liquid cartridge is mounted to the printer, according to an embodiment of the invention.

FIG. 11 is a flowchart shown the process of mounting the liquid cartridge 40 to the printer 1. Hereinafter, with respect to the flowcharts and their descriptions in this application, S stands for a step. At the start of the process, at Step S1, the controller 100 may determine whether the liquid cartridge 40 is mounted in the predetermined position in the space C based on a signal received from the mount detection switch 159.

When the controller 100 detects that the liquid cartridge 40 is mounted in response to receipt of the ON signal from the mount detection switch 159, e.g., "YES" at Step S1, then, at Step S2, referring to FIG. 8, controller 100 may control a moving mechanism 155 to move the base portion 154 in the primary direction. That is, referring to FIG. 7B, the moving mechanism 155 may move the base portion 154 in the direction shown by a solid arrow in FIG. 7B, along with the hollow tube 153 supported by the base portion 154. In Step S2, the hollow tube 153 may start to move from the non-insertion position, e.g., the position shown in FIG. 7A, to an insertion position, e.g., the position shown in FIG. 7B, in which the hollow tube 153 may be insertable into the plug 50. At this time, as shown in FIG. 5B, the hollow tube 153 may pass through approximately the center of the plug 50 via the opening 46*a* in the primary direction, forming a hole in the plug 50.

The plug 50 thus shifts from a closed state in which the ink outlet path 43*a* is closed, e.g., a state in which no hole is formed in the plug 50, to an open state in which the ink outlet path 43*a* is open, e.g., a state in which a hole is formed in the plug 50. Thus, an opening 153*b* that is formed near the tip of the hollow tube 153 may be disposed in the ink outlet path 43*a*, and the inlet path 153*a* in the hollow tube 153 may be placed in fluid communication with the ink outlet path 43*a*. Although a hole is formed in the plug 50 by the hollow tube 153, the elastic properties of the plug 50 may cause the plug 50 to close around the hollow tube 153 by elasticity. This closing around the hollow tube 153 may reduce or eliminate the potential for ink leakage between the hole in the plug 50 and the hollow tube 153.

The tip of the hollow tube 153 then may contact the valve body 62. As the hollow tube 153 is inserted further into the ink outlet path 43*a*, the valve body 62 may move together with the O ring 61, and the O ring 61 may separate from the valve seat 43*z*, to arrive at the position shown in FIG. 5B. At this time, the valve 60 may transition from the closed position to the open position. When the valve 60 is in the open position, the reservoir 42 and an exterior of the fluid cartridge 40 may be placed in fluid communication via the ink outlet path 43*a*. Specifically, as shown in FIG. 5B, when the hollow tube 153 passes through the plug 50, and the valve 60 is in the open position, the reservoir 42 is fluid communication with the ink path of each head 2 via the ink outlet path 43*a* and the inlet path 153*a*.

After Step S2 is completed, then at Step S3, the controller 100 may read the information stored in the memory 141 of the liquid cartridge 40. Referring to FIG. 12, which is an example of the information stored in memory 141, the information read by the controller 100 may include the number "a" that corresponds to the insertion number, and the number "X" that corresponds to the maximum insertion number.

After Step S3 is completed, then at Step S4, the controller 100 may calculate a number "a+1", which is calculated by adding one to the number "a" representing the insertion number stored in the insertion number information read in Step S3. The controller 100 then may determine whether the calculated number "a+1" exceeds the number "X" representing the maximum insertion number stored in the maximum insertion number information.

When the number "a+1" exceeds the number "X," e.g., "YES" at Step S4: Yes, then controller 100 may transition to Step S5, and, with reference to FIG. 8, may cause an output unit 160, e.g., a display or speaker of the printer 1 to notify the user of an error. Specifically, this error may indicate that there is a possibility that the plug 50 of the liquid cartridge 40 may be broken. After Step S5 is completed, the controller 100 may stop the operation of each component of the printer 1 at Step S6. When the number "a+1" does not exceed the number "X,: e.g., "NO: at Step S4, then at Step S7, the controller 100 may determine whether the valve 60 is in the open position based on a value output signal received from the Hall device 71.

Figure 10:
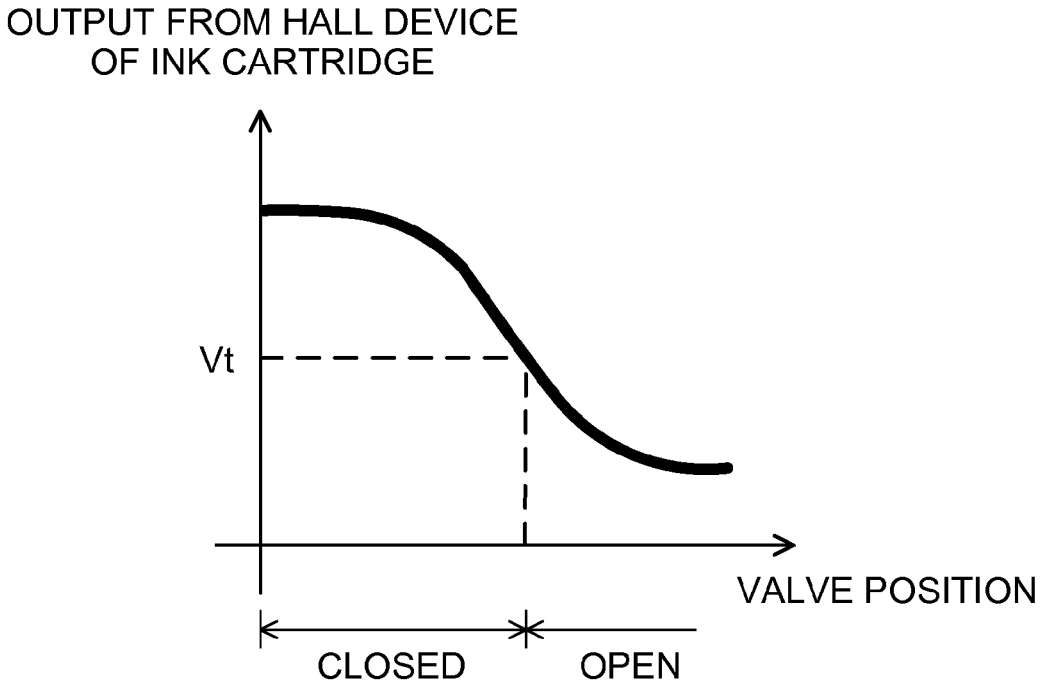
FIG. 10 is a graph illustrating the relationship between a valve position of a valve of the liquid cartridge and output values of a Hall device in the liquid cartridge, according to an embodiment of the invention.

FIG. 10 is a graph illustrating relationship between the amount of movement of the valve 60 and output values of the Hall device 71. The horizontal X-axis of the graph represents the amount of movement of the valve 60 in a direction away from the plug 50 from the closed position shown in FIG. 5A along the primary direction. In an embodiment of the invention, the controller 100 determines that, when the output value of the Hall device 71 is smaller than or equal to a threshold Vt, the valve 60 is in the open position.

When the controller 100 determines that the valve 60 is in the open position, e.g., "YES" at Step S7, then at Step S9, the controller 100 may write the number "a+1" representing the insertion number "a," stored in the insertion number information read in Step S3, plus one (1), into the RAM area of the memory 141 as new insertion number information. The controller 100 then may transition to Step S8. At Step S8, if the controller 100 determines that a predetermined time has elapsed with the valve 60 remaining in the closed position, e.g., "YES" at Step S8, then the controller 100 may transition to Step S5 to execute error notification as described above, and at Step S6, the controller 100 may stop the operation of each of components of the printer 1, as described above. In an embodiment of the invention, the controller 100 assumes that if the valve 60 remains closed while the entire predetermined time has elapsed, then the liquid cartridge 40 may have a problem in, e.g., the sensor unit 70, the plug 50, or the valve 60, or the printer 1 has a problem in, e.g., the hollow tube 153 or the moving mechanism 155.

After Step S9, the controller 100 may execute a recording control at Step S10 for recording a color image on a sheet P, and then controller 100 may end processing for this routine. At Step S10, in the recording control, the controller 100 may perform operations in accordance with an image recording direction, e.g., a color image recording direction received from an external device, e.g., referring to FIG. 8, controls to drive the sheet feed motor 125, the transport motor 127, the feed motor 128, and the heads 2. In an embodiment of the invention, when cartridges 40 are simultaneously mounted to the printer 1, the controller 100 executes the routine shown in FIG. 11 for each cartridge 40.

In order to remove the liquid cartridge 40 from the printer 1, the liquid cartridge tray 35 is removed from the housing 1*a*. At this time, each of the four liquid cartridges 40 is separated from the corresponding base portion 154, the corresponding contact 152, and the corresponding electric power output portion 157. Electric connections between the contact 142 and the contact 152 and between the electric power input portion 147 and the electric power output portion 157 thus may be canceled. This disables transmission and reception of signals between the liquid cartridges 40 and the printer 1 and stops electric power supply from the electric power source 158 to the sensor unit 70 and the memory 141. At this time, the signal output from the mount detection switch 159 may transition from ON to OFF. In addition, the ink outlet tube 43 may move rightward in FIG. 5B, such that the hollow tube 153 is disconnected from the ink outlet path 43*a*. The valve 60 may move leftward in FIG. 5B due to the urging force of the coil spring 63 and may contact the valve seat 43*z*, thus transitioning from the open position to the closed position. Thus, the reservoir 42 and the exterior of the fluid cartridge 40 via the ink outlet path 43*a* may no longer be in fluid communication. Then, the hollow tube 153 may be disconnected from the plug 50.

When the controller 100 detects that the liquid cartridge 40 is removed in response to receipt of the OFF signal from the mount detection switch 159, the controller 100 may control the moving mechanism 155 to move the hollow tube 153 from the insertion position, e.g., the position shown in FIG. 7B, to the non-insertion position, e.g., the position shown in FIG. 7A. The hole formed in the plug 50 by the hollow tube 153 may shrink, due to elasticity of the plug 50, to such a degree that the potential for ink leakage is reduced. In an embodiment of the invention, the plug 50 may close the hole completely.

Figure 9:
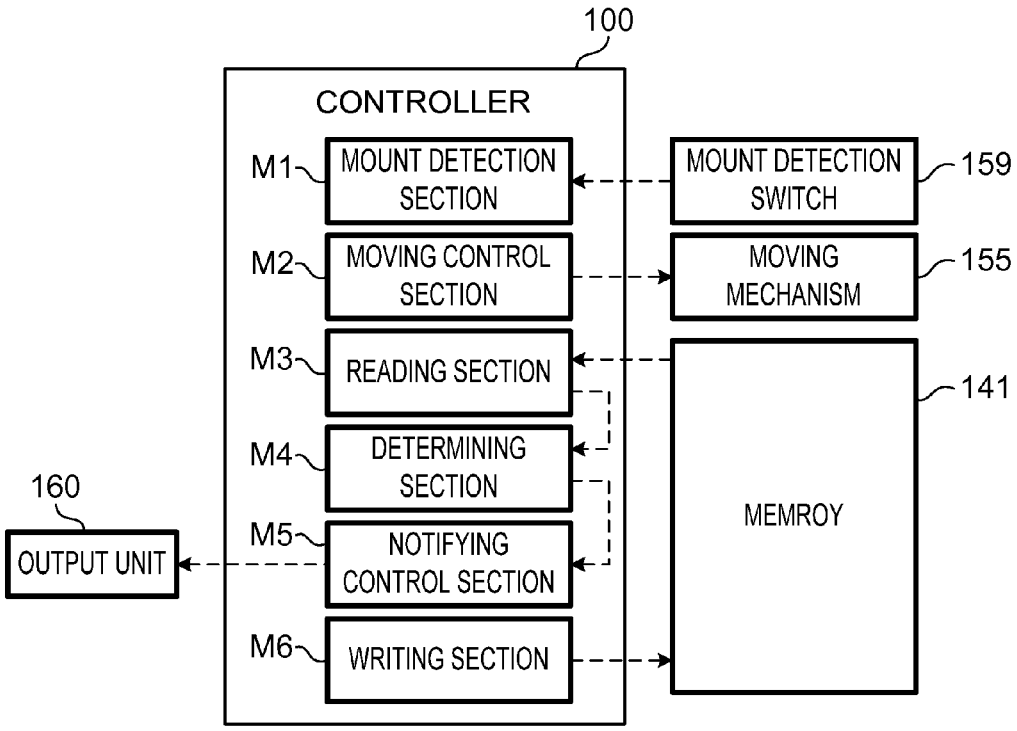
FIG. 9 is a function block diagram illustrating portions of a controller of the printer, according to an embodiment of the invention.

Referring to FIG. 9, in an embodiment of the invention the controller 100 may comprise a mount detection section M1 corresponding to Step S1 in FIG. 11, a moving control section M2 corresponding to Step S2, a reading section M3 corresponding to Step S3, a determining section M4 corresponding to Step S4, a notifying control section M5 corresponding to Step S5, and a writing section M6 corresponding to Step S9. The illustrated layout of a controller 100 is provided merely as an exemplary layout, and in other embodiments the controller 100 may be laid out in any manner sufficient to carry out at least the tasks described above with respect to FIG. 11.

Figure 13:
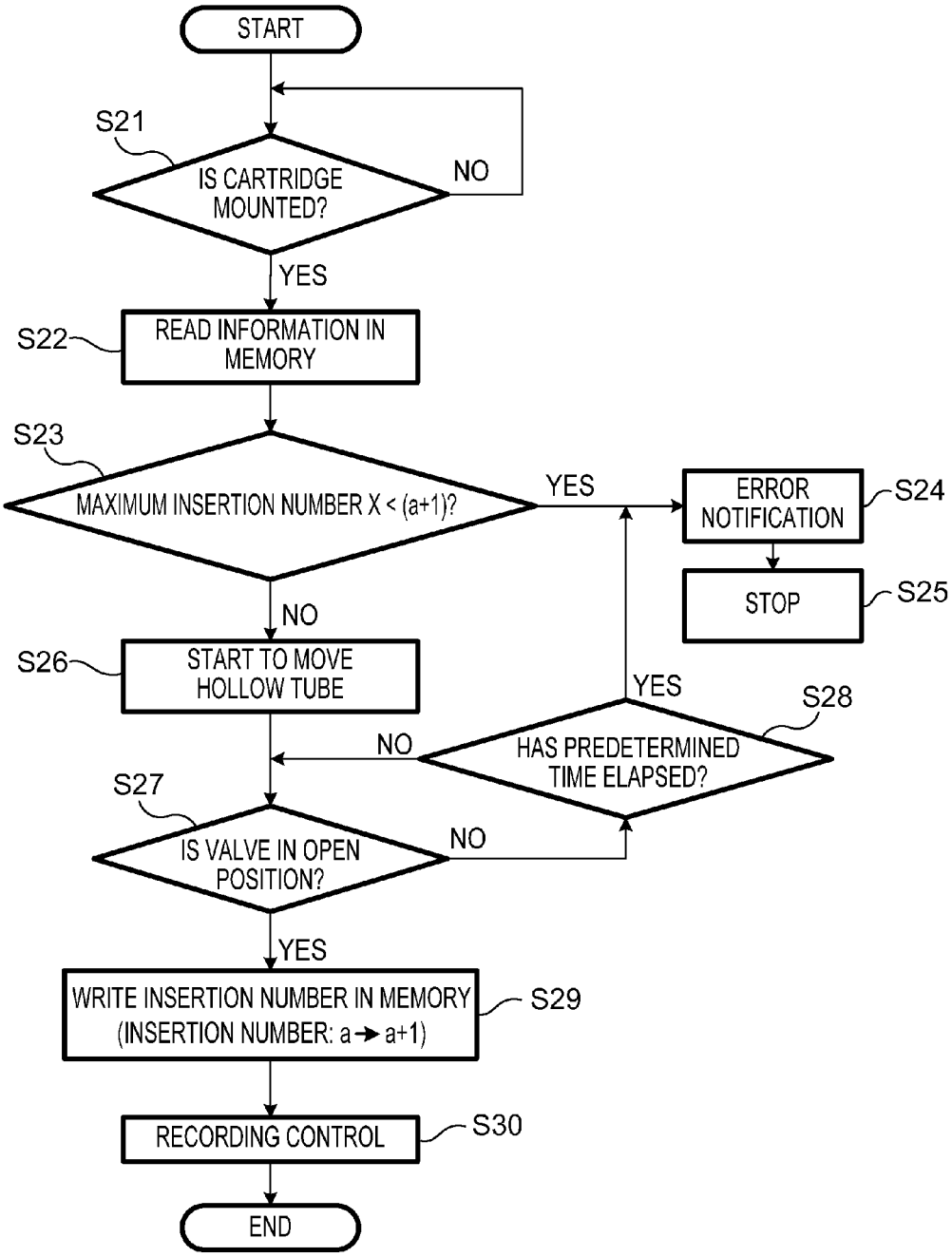
FIG. 13 is a flow chart illustrating steps performed by the controller of the printer according to another embodiment of the invention.

FIG. 13 shows an inkjet printer according to another embodiment of the invention. The printer of the second embodiment is identical in structure to the printer 1 of the first embodiment except for controls the controller 100 executes. The liquid cartridges 40 of the first embodiment are mounted to the printer of the second embodiment.

In the another embodiment, the controller 100 may execute a Step S21, which is similar to Step S1 of FIG. 11. In Step S21, when the controller 100 determines that the liquid cartridge 40 has been mounted, e.g., "YES" at Step S21, then in Step S22, the controller 100 may reads the information stored in the memory 141 of the liquid cartridge 40, e.g., the number "a" that corresponds to the insertion number, and the number "X" that corresponds to the maximum insertion number, as shown in FIG. 12, before starting to move the hollow tube 153. After executing Step S22, the controller 100 may execute Steps S23-S25, which are similar to Steps S4-S6 described above. When the number "a+1" representing the insertion number plus one does not exceed the maximum insertion number "X," e.g., "NO" at Step S23, the controller 100 may execute Step S26, which is similar to Step S2. After executing S26, the controller 100 may execute Steps S27-S30, and then may ends the routine. The another embodiment described with respect to FIG. 13 differs from the first described embodiment in the timing to move the hollow tube 153.

Figure 14:
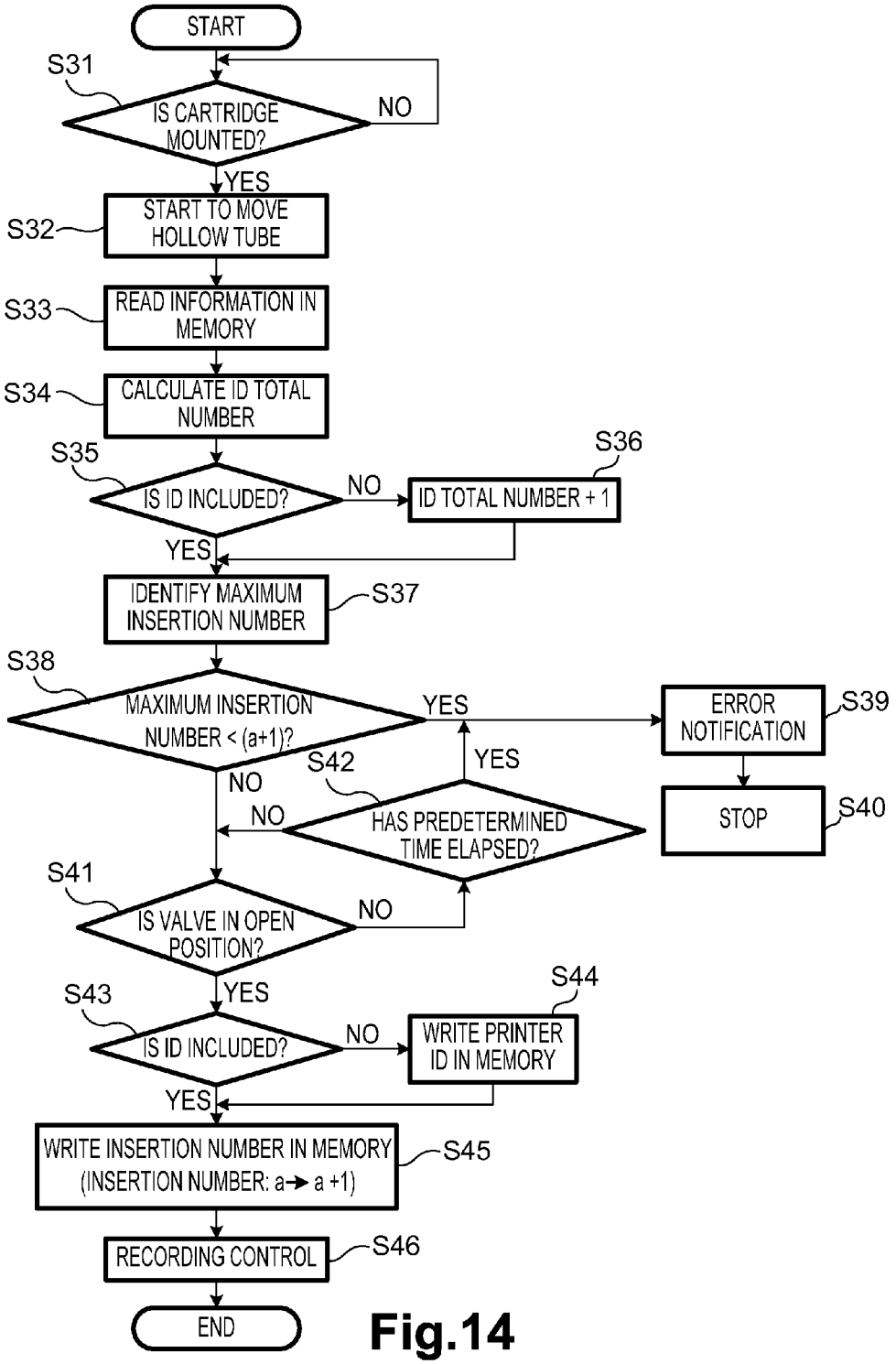
FIG. 14 is a flow chart illustrating steps performed by controller of the printer according to yet another embodiment of the invention.
Figure 16:
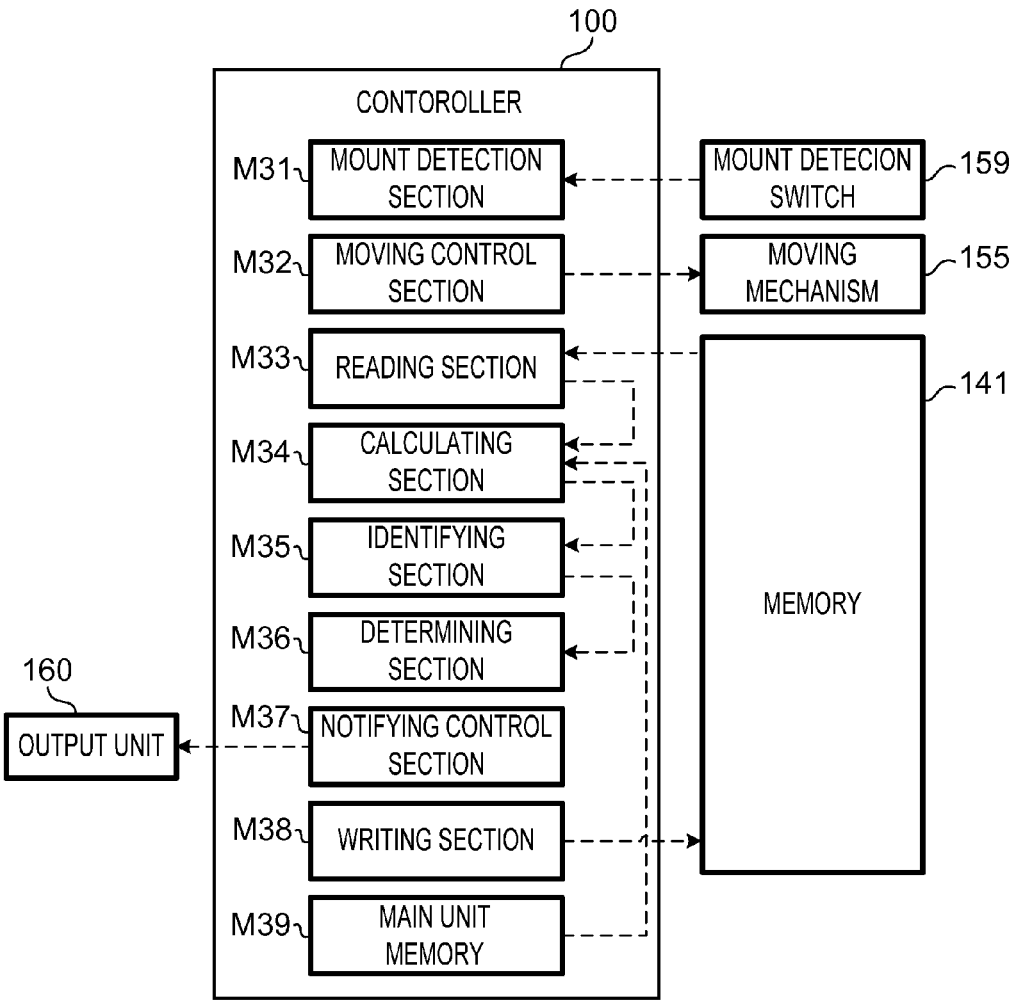
FIG. 16 is a function block diagram illustrating portions of the controller according to the yet another embodiment of the invention.

FIGS. 14-16 show an inkjet printer according to yet another embodiment of the invention. The printer shown in yet another embodiment is identical in structure to the printer 1 of the first described embodiment except for the controls that the controller 100 executes, and the information stored in the memory 141 of the liquid cartridge 40. FIG. 15 shows the memory 141 of the liquid cartridge 40 mounted in the printer according to the yet another embodiment. This memory 141 is configured to store a first table in the RAM area and a second table in the ROM area. The first table stores printer IDs and an insertion number. In the first table, the printer IDs are not associated with the insertion number. The second table stores the number of printer IDs and maximum insertion numbers, which are associated with each other in a one-to-one relationship.

In the yet another embodiment, each printer may have a printer ID that uniquely identifies the printer, and the printer ID of the printer 1 may be stored in the ROM of the controller 100. In an embodiment of the invention, the printer ID of the printer 1 may be stored in a particular object area, and printer IDs of subsequent printers may be stored in a further object area and a third object area. Specifically, the printer ID may correspond to particular object data, referring to a particular object, e.g., the hollow tube 153 of printer 1. The number of printers to which the liquid cartridge 40 was mounted may be equal to the total number of printer IDs stored in the first table. In the yet another embodiment of the invention, the "printers" of "the number of printers to which the liquid cartridge 40 was mounted" must be unique and different from each other. For example, in the yet another embodiment, if the liquid cartridge 40 were mounted in the same printer again and again, the memory 141 would store the number of printers to which the liquid cartridge 40 has been mounted as 1.

The position of a hole to be formed in the plug 50, or the position of the plug 50 into which the hollow tube 153 is inserted, may vary between different printers because there may be printer-to-printer variation in the hollow tube position and the position where the cartridge is mounted. Thus, each printer ID relatively corresponds to a position of the plug 50 into which the hollow tube 153 is inserted. The number of printer IDs corresponds to the number of printers and the number of positions of the plug 50 into which the hollow tube 153 is inserted. Thus, for example, a first printer 1 may create a hole in plug 50 at a first position, and a second printer 1 may create~~Y~~ a hole in plug 50 at a second position. If the first position and the second position are sufficiently different, then the elasticity of plug 50 may change at different rates based on use of the first position and the second position, so that, with many uses of the first printer 1, the elasticity of plug 50 at the first position may be relatively less able to seal the hole than the elasticity of plug 50 at the second position.

In an example shown in FIG. 15, the first table stores that the liquid cartridge 40 has been mounted to a total of two printers ID1 and ID2, and that the hollow tubes 153 of the printers ID1 and ID2 were inserted into the plug 50 a total of "a" times. The second table stores the number of IDs, 1, 2, and 3 and the maximum insertion numbers X, Y, and 0 (zero) associated with each other. The maximum insertion numbers X, Y, and 0 (zero), may be different from each other (X>Y>0).

The maximum insertion number X may be a first number, the maximum insertion number Y may be a second number, and 0 (zero) may be stored as a third number. In an embodiment of the invention, the third number may not be zero, but may be any number. The first number may be stored as first position sealing data, the second number may be stored as second position sealing data, and the third number may be stored as third position sealing data.

As shown in FIG. 14, in the yet another embodiment, the controller 100 executes Steps S31-S33, which are similar to Steps S1-S3 of FIG. 11, respectively. After Step S33, then at Step S34, the controller 100 may calculate a total number of IDs stored in information read in Step S33. This number calculated by controller 100 may correspond to the total number of unique printers to which the liquid cartridge 40 has been mounted. In the example shown in FIG. 15, the controller 100 may calculate that the total number of IDs is 2.

After executing Step S34, then at Step S35, controller 100 may determine whether the information read in Step S33 includes an ID stored in the ROM of the controller 100. When the controller 100 determines that the information read in Step S33 includes the ID stored in the ROM, e.g., "YES" at Step S35, then the controller 100 transitions to Step S37. When the controller 100 determines that the information read in Step S33 does not include the ID stored in the ROM, e.g., "NO" at Step S35, the controller 100 executes Step S36. At Step S36, the controller 100 calculates a number obtained by adding one (1) to the number of IDs calculated in Step S34, and then transitions to Step S37.

In Step S37, the controller 100 may identify a maximum insertion number that is associated with the number calculated in S34 or S36 from the maximum insertion number information read in S33. For example, when the printer has ID1 and the liquid cartridge 40 having the memory 141 that stores the information shown in FIG. 15 is mounted in the printer, the controller 100 may determine that the information read in Step S33 includes the printer ID1, e.g., "YES" at Step S35, and then controller 100 may identify the maximum insertion number "Y" associated with the number calculated in Step S34, e.g., the total number of IDs=2.

After Step S37, then in Step S38, controller 100 may determine whether a number "a+1", which is calculated by adding one (1) to the number "a" representing the insertion number stored in the insertion number information read in Step S33, exceeds the maximum insertion number identified in Step S37. The controller 100 then executes Steps S39-S42, which are similar to Steps S5-S8.

In Step S41, the controller 100 may determine the state of valve 60. When the controller 100 determines that the valve 60 is in the open position, e.g., "YES" at Step S41, then at Step S43, the controller 100 may determine whether the information read in Step S33 includes the ID stored in the ROM of the controller 100. When the controller 100 determines that the information read in Step S33 includes the ID stored in the ROM, e.g. "YES" at Step S43, the controller 100 then may transition to Step S45. When the controller 100 determines that the information read in Step S33 does not include the ID stored in the ROM, e.g., "NO" at Step S43, then at Step S44, the controller 100 may write the ID stored in the ROM in the first table of the memory 141, and then may transition to Step S45. The controller 100 then may execute Steps S45 and S46, which are similar to Steps S9 and S10 respectively, and then may end the routine.

In the yet another embodiment, as shown in FIG. 16, the controller 100 may comprise a mount detection section M31 corresponding to Step S31 of FIG. 14, a moving control section M32 corresponding to Step S32, a reading section M33 corresponding to Step S33, a calculating section M34 corresponding to Steps S34-S36, an identifying section M35 corresponding to Step S37, a determining section M36 corresponding to Step S38, a notifying control section M37 corresponding to Step S39, a writing section M38 corresponding to Steps S44-S45, and a main unit memory M39 corresponding to the ROM of the controller 100. The illustrated layout of the controller 100 according to yet another embodiment of the invention, as shown in FIG. 16, is provided merely as an exemplary layout, and in other embodiments the controller 100 may be laid out in any manner sufficient to carry out at least the tasks described above with respect to FIG. 14.

Figure 17:
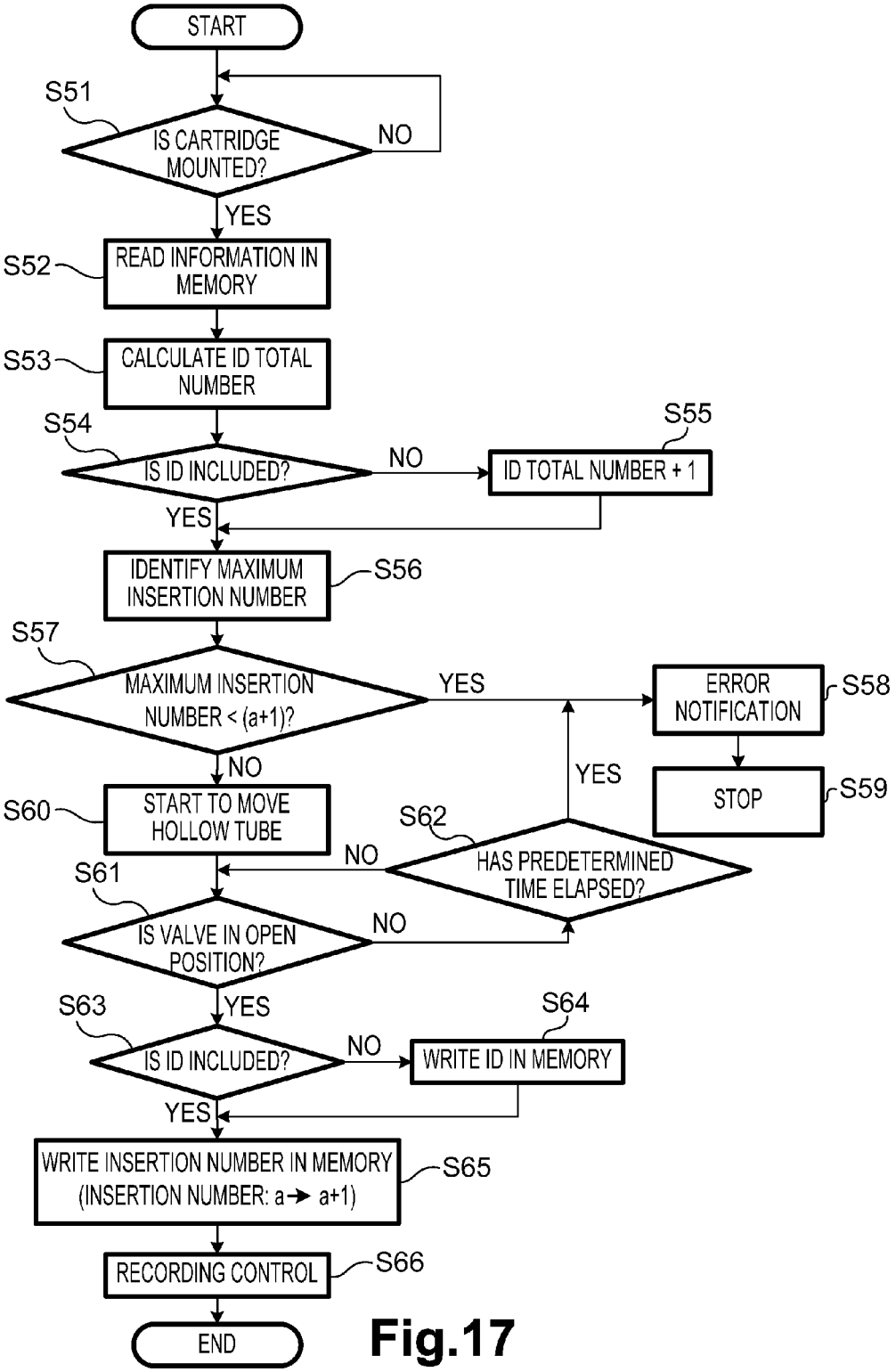
FIG. 17 is a flow chart illustrating steps performed by the controller of the printer according to a still another embodiment of the invention.

FIG. 17 shows an inkjet printer according to still another embodiment of the invention. The printer 1 of the still another embodiment may be substantially identical in structure to the printer of the yet another embodiment, except for the controls executed by the controller 100. The liquid cartridges 40 of the still another embodiment may be substantially identical to the yet another embodiment, and may be mounted to the printer 1 of the still another embodiment in substantially the same manner.

Referring to FIG. 17, in the still another embodiment, the controller 100 first may execute Step S51, which is similar to Step S31 of FIG. 14. When the controller 100 determines that the liquid cartridge 40 has been mounted, e.g., "YES" at Step S51, then at Step S52, the controller 100 may read information stored in the memory 141 of the liquid cartridge 40, before starting to move the hollow tube 153. The memory 141 of the still another embodiment is substantially the same as the memory 141 of the yet another embodiment, e.g., the memory shown in FIG. 15. After executing Step S52, the controller 100 may executes Steps S53-S57, which are similar to Steps S34-S38. When the number "a+1" representing the insertion number plus one (1) does not exceed the maximum insertion number "X," e.g., "NO" at Step S57, the controller 100 may execute Step S60, which is similar to Step S32. After Step S60, the controller 100 may execute Steps S61-S66, which are similar to Steps S41-S46, and then may end the routine.

The still another embodiment is different from the yet another embodiment in timing to move the hollow tube 153. The timing to move the hollow tube 153 is similar to the timing to move the hollow tube 153 described in the another embodiment above.

FIGS. 18-21 show an inkjet printer according to a further embodiment. The printer of the further embodiment is identical in structure to the printer of the yet another embodiment except for the controls the controller 100 executes and the information stored in the memory 141 of the liquid cartridge 40. The memory 141 of the ink cartridge 40 mounted in the printer of the further embodiment may store printer IDs and insertion numbers, which, in an embodiment of the invention, may be associated with each other in a one-to-one relationship, e.g., as shown in memory 141 in FIGS. 19 and 20.

Specifically, in an example shown in FIG. 19, the memory 14 may store a first table in the RAM area and a second table in the ROM area. The first table may store a plurality of, e.g., three, printer IDs and an equal number of insertion numbers. The insertion numbers are each associated with one printer ID, thus forming a one-to-one relationship between printer IDs and insertion numbers. The second table may store maximum insertion numbers with respect to a number of printer IDS stored in the RAM area, in the same way as previously described and shown in FIG. 15.

For example, in FIG. 19, the first table may store data indicating that the liquid cartridge 40 has been mounted to two printers ID1 and ID2, and that the plug 50 was pierced a total of "a" times with the hollow tube 153 of the printer ID1 and a total of "b" times with the hollow tube 153 of the printer ID2. The number "a" may be a first count data, which may be stored in the first count storage area. The number "b" may be a second count data, which may be stored in the second count storage area.

In another example shown in FIG. 20, the memory 141 may store that the ink cartridge 40 has been mounted to three printers ID1, ID2, and ID3, and that the plug 50 of the ink cartridge 40 was pierced a total of "a" times with the hollow tube 153 of the printer ID1, a total of "b" times with the hollow tube 153 of the printer ID2, and a total of "c" times with the hollow tube 153 of the printer ID3, and that the maximum insertion numbers X, Y, and Z are stored in association with the number of printer IDs 1, 2, and 3. The maximum insertion numbers X, Y, and Z, may be greater than 1, and may be different from each other. Specifically, the maximum insertion numbers may be related such that X>Y>Z.

Figure 18:
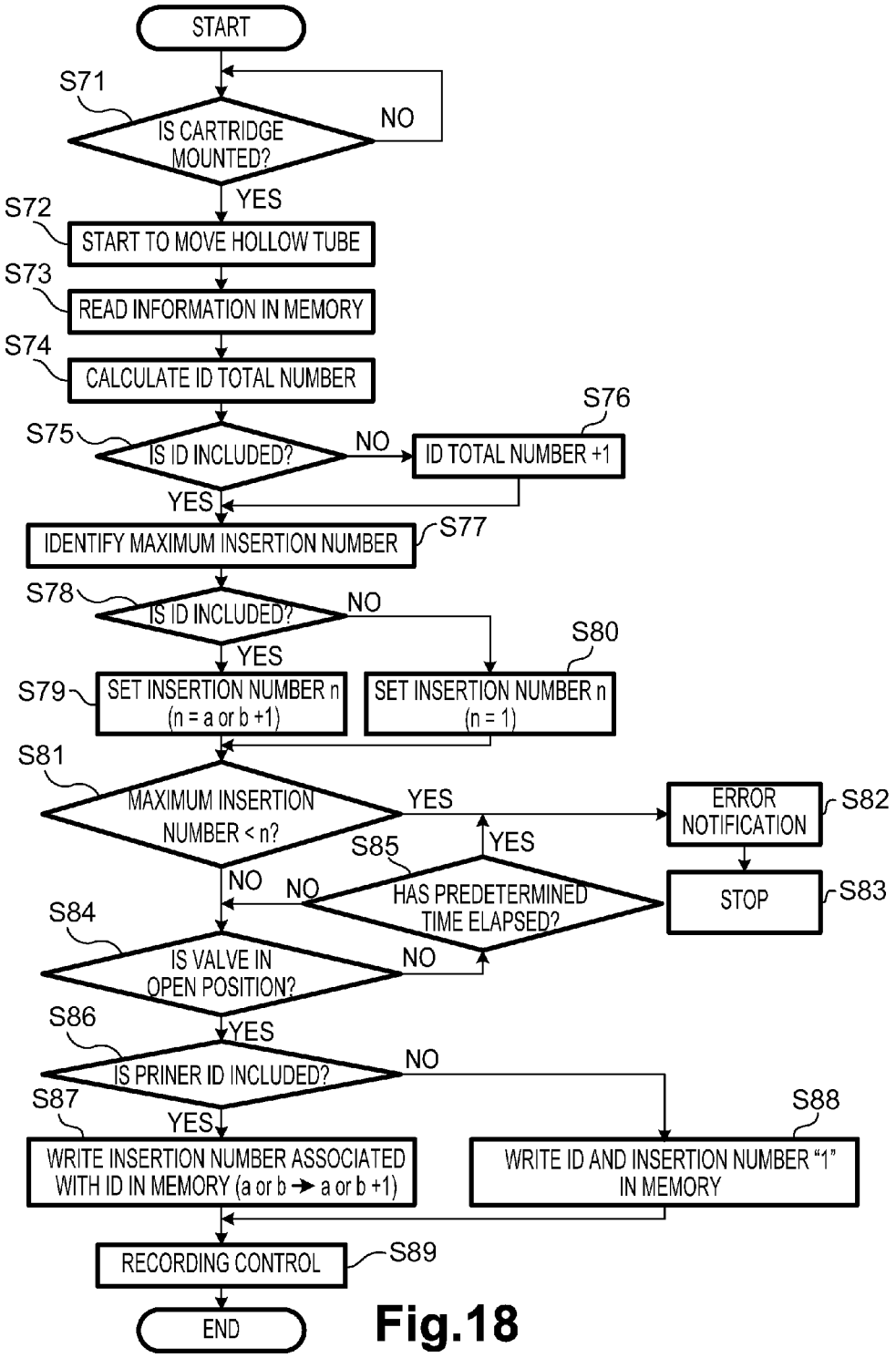
FIG. 18 is a flow chart illustrating operation of a controller of the printer according to a further embodiment of the invention.

In the further embodiment, as shown in FIG. 18, the controller 100 may execute Steps S71-S77, which are similar to Steps S31-S37, respectively. After Step S77, in Step S78, the controller 100 may determine whether the information read in Step S73 includes an ID stored in the ROM of the controller 100.

When the controller 100 determines that the information read in Step S73 includes the ID stored in the ROM, e.g., "YES" at Step S78, then in Step S79, controller 100 may set a number made by adding one (1) to an insertion number associated with the ID read in Step S73, as a new insertion number "n." For example, when the printer has ID1 and the liquid cartridge 40 having the memory 141 storing the information shown in any one of FIG. 19 and FIG. 20 is mounted in the printer having ID1, the controller 100 may set, as a new insertion number "n", a number "a+1" made by adding one to a number "a" representing the insertion number associated with the printer ID1 in the memory 141. Alternatively, when the printer has ID2 and the liquid cartridge 40 having the memory 141 storing the information shown in any one of FIG. 19 and FIG. 20 is mounted in the printer having ID2, the controller 100 sets, as a new insertion number "n", a number "b+1" made by adding one to a number "b" representing the insertion number associated with the printer ID2 in the memory 141. Alternatively, when the printer has ID3 and the ink cartridge 40 having the memory 141 storing information shown in FIG. 20 is mounted in the printer, the controller 100 sets, as a new insertion number "n", a number "c+1" made by adding one to a number "c" representing the insertion number associated with the printer ID3 in the memory 141.

When the controller 100 determines that the information read in Step S73 does not include the ID stored in the ROM, e.g., "NO" at Step S78, then at Step S80, controller 100 may set a new insertion number "n" to 1. After executing either Step S79 or Step S80 as above, then at Step S81, controller 100 may determine whether the insertion number "n" set in Step S79 or Step S80 exceeds the maximum insertion number identified in S77. Then, the controller 100 may execute Steps S82-S86, which are similar to Steps S39-S43, respectively.

When the controller 100 determines that the information read in S73 includes the ID stored in the ROM, e.g., "YES" at Step S86, then at Step S87, controller 100 may write the number "a+1", "b+1" or "c+1", which is made by adding one (1) to the insertion number "a", "b" or "c" associated with the printer ID read in Step S73, as a new insertion number associated with the printer ID, into the memory 141. When the controller 100 determines that the information read in Step S73 does not include the ID stored in the ROM, e.g., "NO" at Step S86, then in Step S88, the controller 100 may write the ID stored in the ROM and "1" as an insertion number associated with the printer ID into the first table of the memory 141. After executing Step S87 or Step S88, the controller 100 then may execute Step S89, which is similar to Step S46 and then controller 100 may end the routine.

Figure 21:
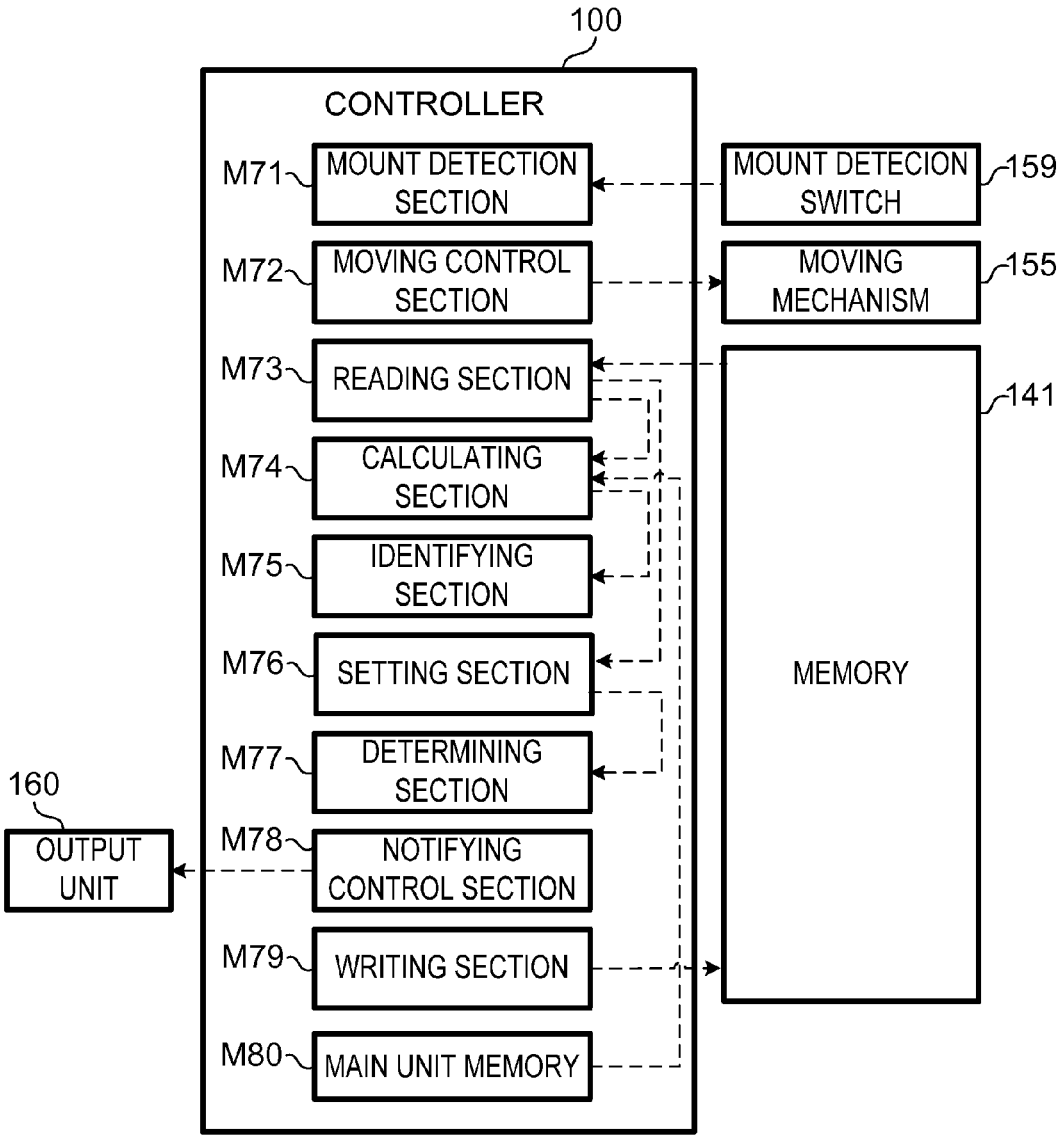
FIG. 21 is a function block diagram illustrating portions of the controller according to the further embodiment of the invention.

In the further embodiment, as shown in FIG. 21, the controller 100 may comprise a mount detection section M71 corresponding to Step S71 of FIG. 18, a moving control section M72 corresponding to Step S72, a reading section M73 corresponding to Step S73, a calculating section M74 corresponding to Steps S74-S76, an identifying section M75 corresponding to Step S77, a setting section M76 corresponding to Steps S79 and S80, a determining section M77 corresponding to Step S81, a notifying control section M78 corresponding to Step S82, a writing section M79 corresponding to Steps S87 and S88, and a main unit memory M80 corresponding to the ROM of the controller 100. The illustrated layout of the controller 100 according to yet another embodiment of the invention, as shown in FIG. 21, is provided merely as an exemplary layout, and in other embodiments the controller 100 may be laid out in any manner sufficient to carry out at least the tasks described above with respect to FIG. 18.

Figure 22:
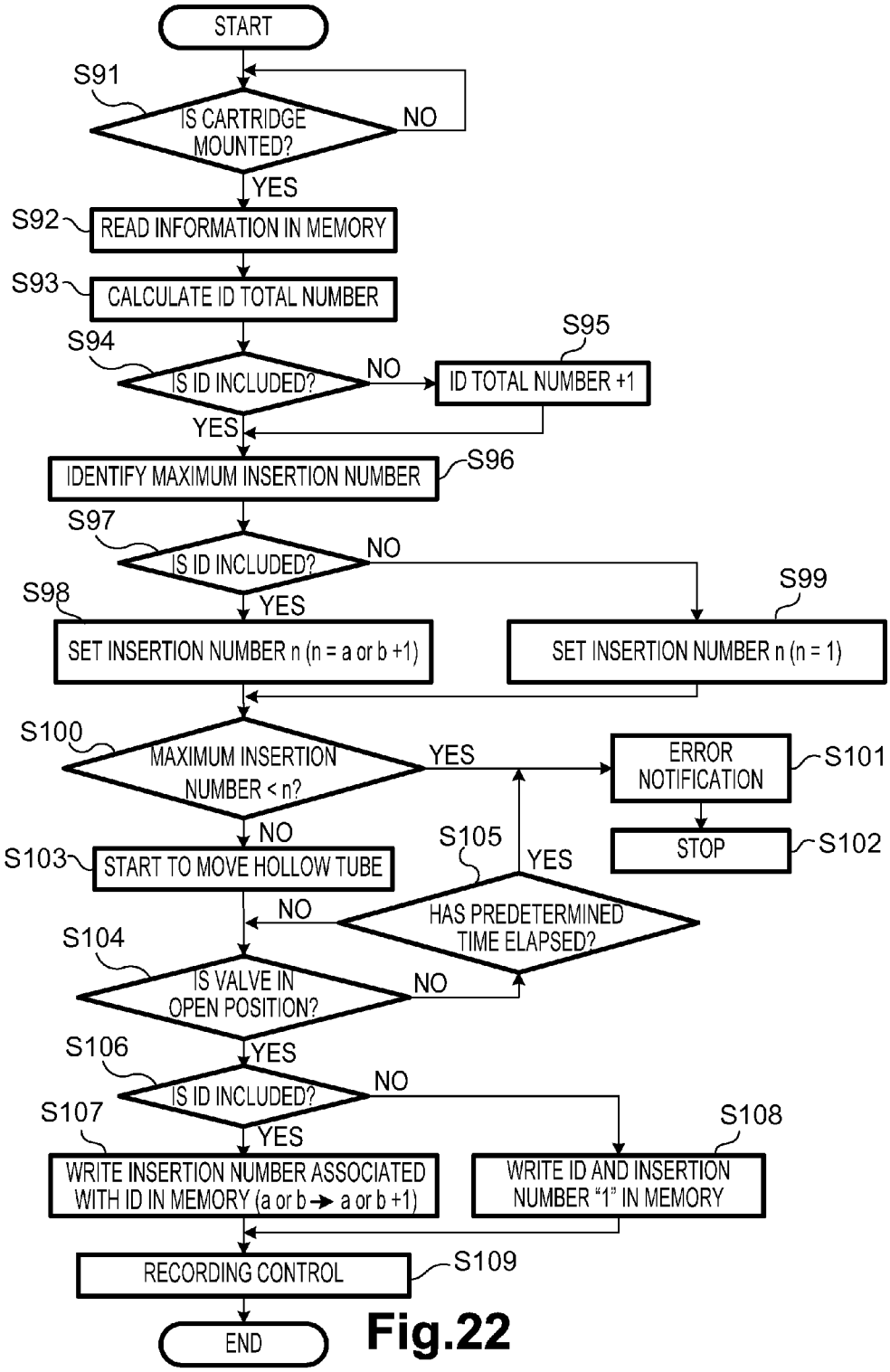
FIG. 22 is a flow chart illustrating steps performed by a controller of an inkjet printer according to a yet further embodiment of the invention

FIG. 22 shows an inkjet printer according to a yet further embodiment. The printer 1 according to the yet further embodiment is substantially identical to the printer 1 of the further embodiment, except for the controls executed by the controller 100. The liquid cartridges 40 of the further embodiment are mounted to the printer of the yet further embodiment. In the yet further embodiment, the controller 100 may execute a Step S91, which is similar to Step S71 of FIG. 18. When the controller 100 determines that the liquid cartridge 40 has been mounted, e.g., "YES" at Step S91, then at Step S92, the controller 100 reads information stored in the memory 141 of the liquid cartridge 40. Memory 141 in this step may be similarly laid out to the further embodiment, e.g., as shown in FIG. 19 and FIG. 20.

Controller 100 may read the information stored in the memory 141 before starting to move the hollow tube 153. After executing Step S92, the controller 100 then may execute Steps S93-S102, which are similar to Steps S74-S83. When the controller 100 determines that the new insertion number "n" set in Steps S98 or S99 does not exceed the maximum insertion number identified in S96, e.g., "NO" at Step 100, then the controller 100 may execute Step S103, which is similar to Step S72. After executing Step S103, the controller 100 may execute Steps S104-S109, which are similar to Steps S84-S89, and then the controller 100 may end the routine. The yet further embodiment is different from the further embodiment in timing to move the hollow tube 153. Specifically, the timing of moving the hollow tube 153 of the yet further embodiment is similar to the another embodiment and the still another embodiment described above.

Figure 23:
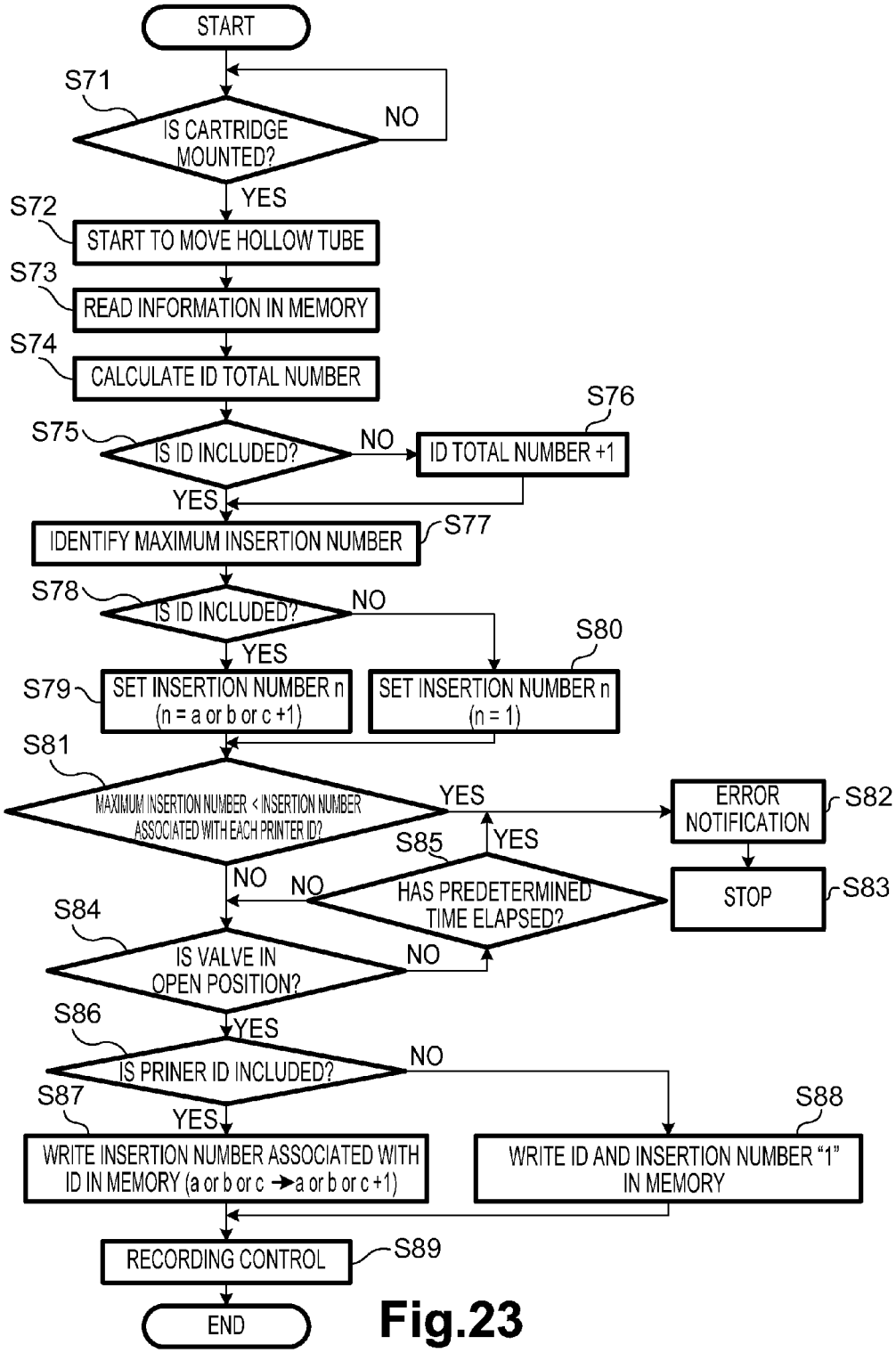
FIG. 23 is a flow chart illustrating steps performed by the controller of the printer according to a still further embodiment of the invention.

FIG. 23 shows an inkjet printer according to a still further embodiment of the invention. The printer of the still further embodiment is identical in structure to the printer 1 of the further embodiment, except for the controls executed by controller 100. The ink cartridges 40 described with respect to the further embodiment also may be mounted to the printer in the still further embodiment. Those steps performed in the still further embodiment shown in FIG. 23 that correspond to the steps of FIG. 18 are identified with the same numbers in FIG. 23.

In the still further embodiment, as shown in FIG. 23, the controller 100 may execute Steps S71-S80. After performing Step S79 or S80, then in Step S81, controller 100 determines whether at least one of the insertion number "n" set in Step S79 or S80 and an insertion number associated with a printer ID which is not the current printer ID, e.g., an ID of any printer to which the cartridge 40 has been previously mounted, exceeds the maximum insertion number identified in Step S77. If the controller 100 determines that none of the insertion numbers "n" stored in memory 141 exceed the maximum insertion number identified in Step S77, e.g., "NO" in Step S100, then the controller 100 moves to Step S84, and processing continues through Step S89, and ends the routine. If the controller 100 determines that any of the insertion numbers "n" stored in memory 141 exceed the maximum insertion number identified in Step S77, e.g., "YES" in Step S100, then the controller 100 executes error notification in Step S101, and stops processing in Step S102.

Figure 24:
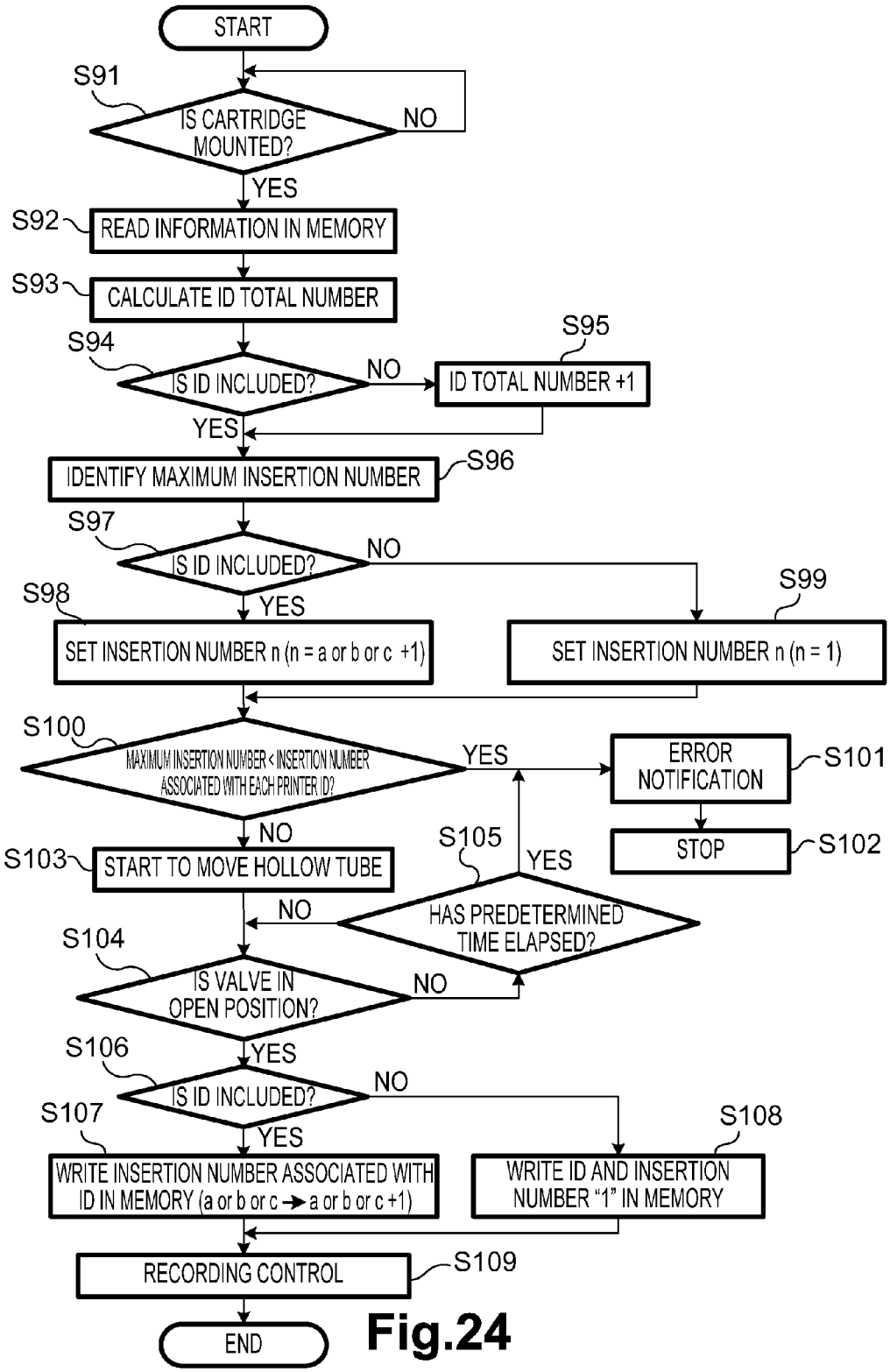
FIG. 24 is a flow chart illustrating steps performed by the controller of the printer according to a still yet further embodiment of the invention.

FIG. 24 shows an inkjet printer according to a still yet further embodiment of the invention. The printer of the still yet further embodiment is identical in structure to the printer 1 of the still further embodiment, except for the controls executed by controller 100. The ink cartridges 40 described with respect to the still further embodiment also may be mounted to the printer in the still yet further embodiment. Those steps performed in the still further embodiment shown in FIG. 24 that correspond to the steps of FIG. 22 are identified with the same numbers in FIG. 24

In the still yet further embodiment, as shown in FIG. 24, the controller 100 may execute Steps S91-S99. After Step S98 or S99, in Step S100, the controller 100 may determine whether at least one of the insertion numbers "n" set in Steps S98 or S99 and an insertion number associated with a printer ID which is not the current printer ID, e.g., an ID of any printer to which the cartridge 40 has been previously mounted, exceeds the maximum insertion number identified in Step S96. If the controller 100 determines that none of the insertion numbers "n" set in Steps S98 or S99 and an insertion number associated with a printer ID which is not the current printer ID is greater than the maximum insertion number identified in Step S96, e.g., "NO" in Step S100, then the controller 100 moves to Step S103, and processing continues through Step S109, and ends the routine. If the controller 100 determines that any of the insertion numbers "n" set in Steps S98 or S99 and an insertion number associated with a printer ID which is not the current printer ID is greater than the maximum insertion number identified in Step S96, e.g., YES" in Step S100, then the controller 100 executes error notification in Step S101, and stops processing in Step S102.

FIG. 25 shows an inkjet printer according to a still yet another further embodiment of the invention. A printer of the still yet another further embodiment may be substantially identical in structure to the printer 1 of the first described embodiment except for that the printer of the still yet another further embodiment omits the moving mechanism 155 shown in FIG. 8. Instead, in the still yet another further embodiment, the hollow tube 153 may be fixed to the wall surface defining the space C of the housing 1*a*.

A liquid cartridge of the still yet another further embodiment may be substantially identical in structure to the liquid cartridge 40 of the first described embodiment except that valve unit 750 is provided instead of the plug 50, the valve 60, and the coil spring 63. In addition, the Hall element 71 and the magnet 72 may be disposed in different positions, and an ink outlet tube 743 may be different in shape from the ink outlet tube 143. The valve unit 750 may comprise a valve seat 751, a valve body 752, and a coil spring 753. The valve seat 751 may comprise of an elastic material, e.g., rubber, and may be formed by providing a through hole 751*a* in the center of the plug 50. The through hole 751*a* may have a diameter smaller than an outside diameter of the hollow tube 153. The valve body 752 may have a substantially cylindrical shape magnetic member formed by excluding the O ring 61 from the valve body 62. The coil spring 753 is identical in structure to the coil spring 63 and may be configured to contact the rear side of the valve body 752 to urge the valve body 752 toward the valve seat 751.

Figure 25A:
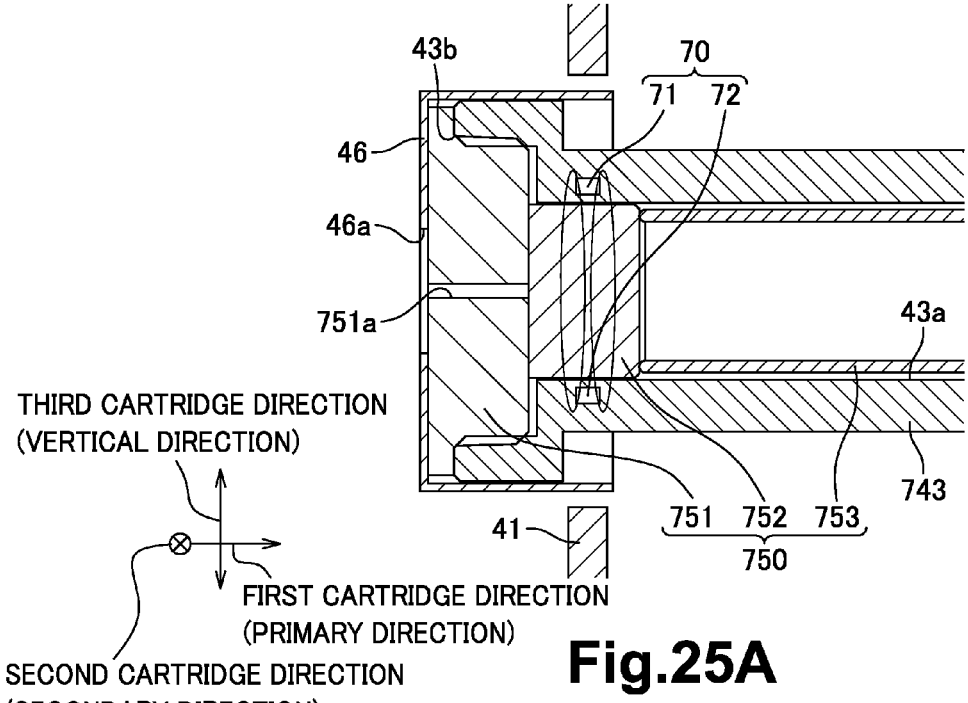
FIG. 25A is a partial cross sectional view of a liquid cartridge according to a still yet another further embodiment of the invention, which still yet another further embodiment of the invention is similar to the embodiment shown in FIG. 5A.

The ink outlet tube 743 may omit the valve seat 43*z* of the first described embodiment. The ink outlet tube 743 of the still yet another further embodiment may have a constant diameter from the inner surface, facing the valve body 752, of the valve seat 751 toward one end of the ink outlet tube 743 opposite to the valve seat 751. As shown in FIG. 25A, in the still yet another further embodiment, the Hall element 71 and the magnet 72 are disposed opposite to each other via the valve body 752 when the valve unit 750 is in a closed state where the ink outlet path 43*a* is closed.

As shown in FIG. 25A, before the liquid cartridge 40 is mounted to the printer, the hollow tube 153 may not be inserted in the valve unit 750, and the valve unit 750 may be maintained in the closed state. In order to mount the liquid cartridge 40 to the printer 1, the liquid cartridge 40 may be placed together with other liquid cartridges 40 in the liquid cartridge tray 35 of the printer 1, e.g., as shown in FIG. 2, and the liquid cartridge tray 35 is inserted into the space C of the housing 1*a* in the primary direction, e.g., in a direction shown by an open arrow in FIG. 7A.

Figure 25B:
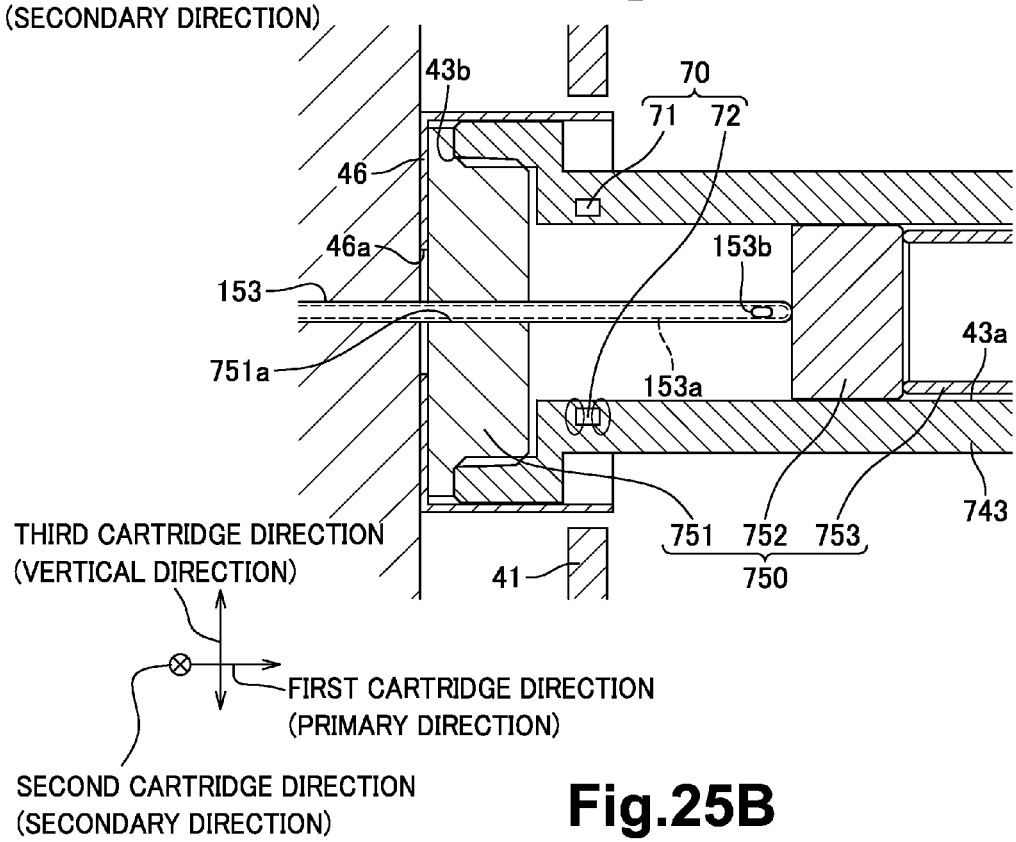
FIG. 25B is a partial cross sectional view of the liquid cartridge of FIG. 25A, when the liquid cartridge is in a similar state as shown in FIG. 5B.

As shown in FIG. 25B, When the liquid cartridge 40 is disposed in the predetermined position in the space C, e.g., at a position where the contact 142 contacts the contact 152, and the electric power input portion 147 contacts the power output portion 157 as shown in FIG. 7A, the hollow tube 153 fixed to the wall surface of the housing 1*a* may pass through the through hole 751*a* of the valve seat 751 and may move the valve body 752 in a direction away from the valve seat 751 against the urging force of the coil spring 753. At this time, the valve unit 750 may transition from the closed state to an open state in which the ink outlet path 43*a* is open. When the valve unit 750 is in the open state, the reservoir 42 may establish fluid communication with the outside via the ink outlet path 43*a*. In this manner, the still yet another further embodiment shows that, when the liquid cartridge 40 is mounted to the printer, the contacts 142 and 152 may be electrically connected to each other, the electric power input portion 147 and the electric power output portion 157 may be electrically connected to each other, the hollow tube 153 may be inserted into the valve unit 750, and the open/unit 750 transitions from the closed state to the open state.

In order to remove the liquid cartridge 40 from the printer 1, the liquid cartridge tray 35 may be removed from the housing 1*a*. At this time, as the ink outlet tube 743 moves rightward in FIG. 25B, so that the hollow tube 153 is removed from the ink outlet path 43*a*, the valve body 752 may move leftward in FIG. 25B, due to the urging force of the coil spring 753, and valve body 752 may contact the valve seat 751. At this time, the valve unit 750 may transition from the open state to the closed state.

In the still yet another further embodiment, the controller 100 may execute the similar controls of the first described and the another embodiments, except that the controller 100 does not execute the control for moving the hollow tube 153 at Steps S2 of the first described embodiment, and Step S26 of the another embodiment.

Figure 26:
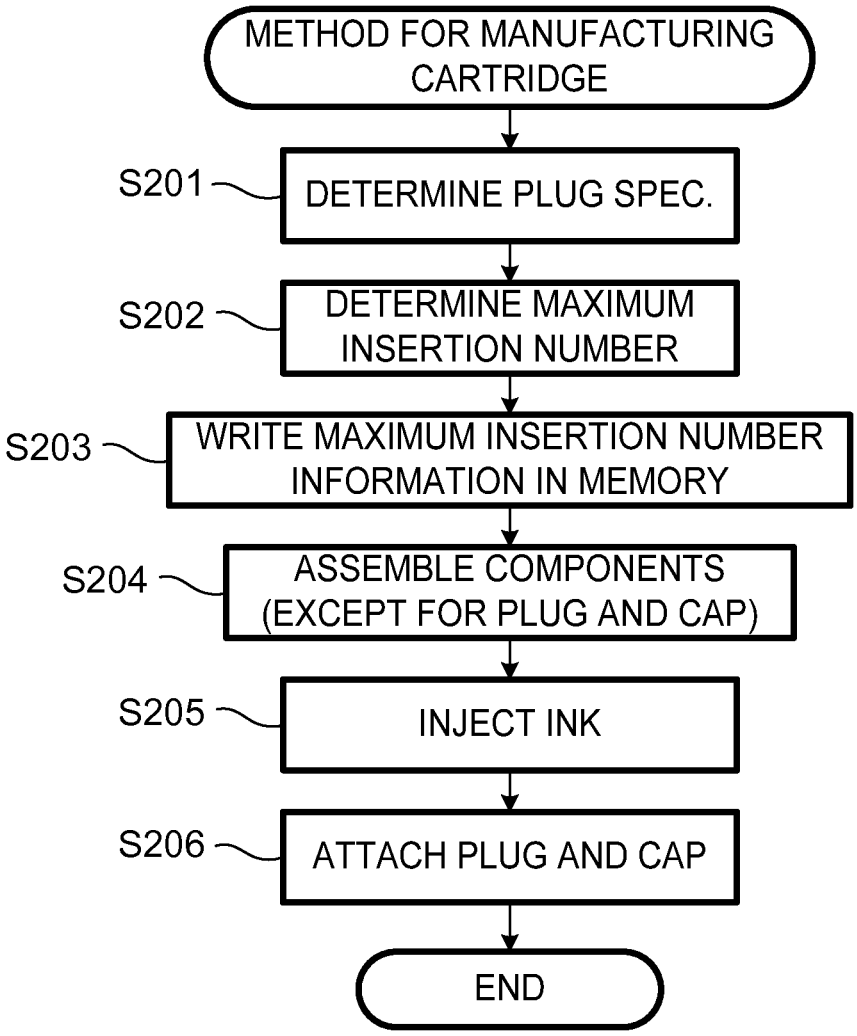
FIG. 26 is a flow chart illustrating a method for manufacturing the liquid cartridge according to various embodiments of the invention.

FIG. 26 shows an example of a method for manufacturing the liquid cartridges 40 according to the previously-described embodiments. Each step in the method for manufacturing the liquid cartridge may be carried out by a manufacturing device or by an operator. In the embodiment described herein, all steps are carried out by the manufacturing device. The manufacturing device may comprise an injector, a part assembling unit, a controller, and a display. In Step S201, at the start of the process, the manufacturing device may determine the specifications of the plug 50, e.g., material, and thickness of the plug 50 relative to the insertion direction of the hollow tube 153.

After executing Step S201, in Step S202, the manufacturing device may determine a maximum insertion number adequate to the specification of the plug 50 determined in S201 In Step S202, the manufacturing device may perform experiments in consideration of the specifications determined in S201 and a moving speed of the hollow tube 153 inserted into the plug 50, in order to determine how many times the hollow tube 153 may be inserted into the plug 50 until ink leaks due to deterioration of the plug 50. The manufacturing device may determine the number of times to prevent ink leakage as the maximum insertion number.

To manufacture the liquid cartridge 40 according to the yet another embodiment through the still yet further embodiment, the manufacturing device determines the number of times to prevent ink leakage for each of the number of printers or printer IDs as maximum insertion number information by the number of printer IDs, in consideration of the position of the plug 50 to which the hollow tube 153 is inserted, which may be different according to the specifications of the different printers.

After executing Step S202, at Step S203, the manufacturing device may cause the controller to write the maximum insertion number information representing the maximum insertion number determined in Step S202 in the ROM area of the memory 141. After S203, then at Step S204, the manufacturing device may activate the part assembling unit to assemble parts constituting the liquid cartridge 40, e.g., the case 41, the reservoir 42, the ink outlet tube 43, the valve 60, the sensor unit 70, the memory 141, and the contact 142, except for the plug 50 and the cap 46. After Step S204, then in Step S205, the manufacturing device may actuate the injector (not shown) to inject ink into the reservoir 42. In Step S205, the manufacturing device may move the valve 60 from the closed position to the open position by inserting a needle of the injector into the ink outlet path 43*a* from the opening 43*b* such that the needle contacts the valve body 62 to move and press the valve body 62 against the urging force of the coil spring 63. The manufacturing device then may actuate an injector pump to inject ink into the reservoir 42 via the needle while maintaining the valve 60 in the open position.

After ink is injected into the reservoir 42, the manufacturing device may remove the needle from the ink outlet path 43*a*. Accordingly, the valve 60 moves from the open position to the closed position because of the urging force of the coil spring 63. After Step S205, while maintaining the valve 60 in the closed position, then at Step S206, the manufacturing device may actuate the part assembling unit to attach the plug 50 and the cap 46 to the opening 43*b*. Thus, manufacturing of the liquid cartridge 40 according to an embodiment of the invention may be completed.

Figure 27:
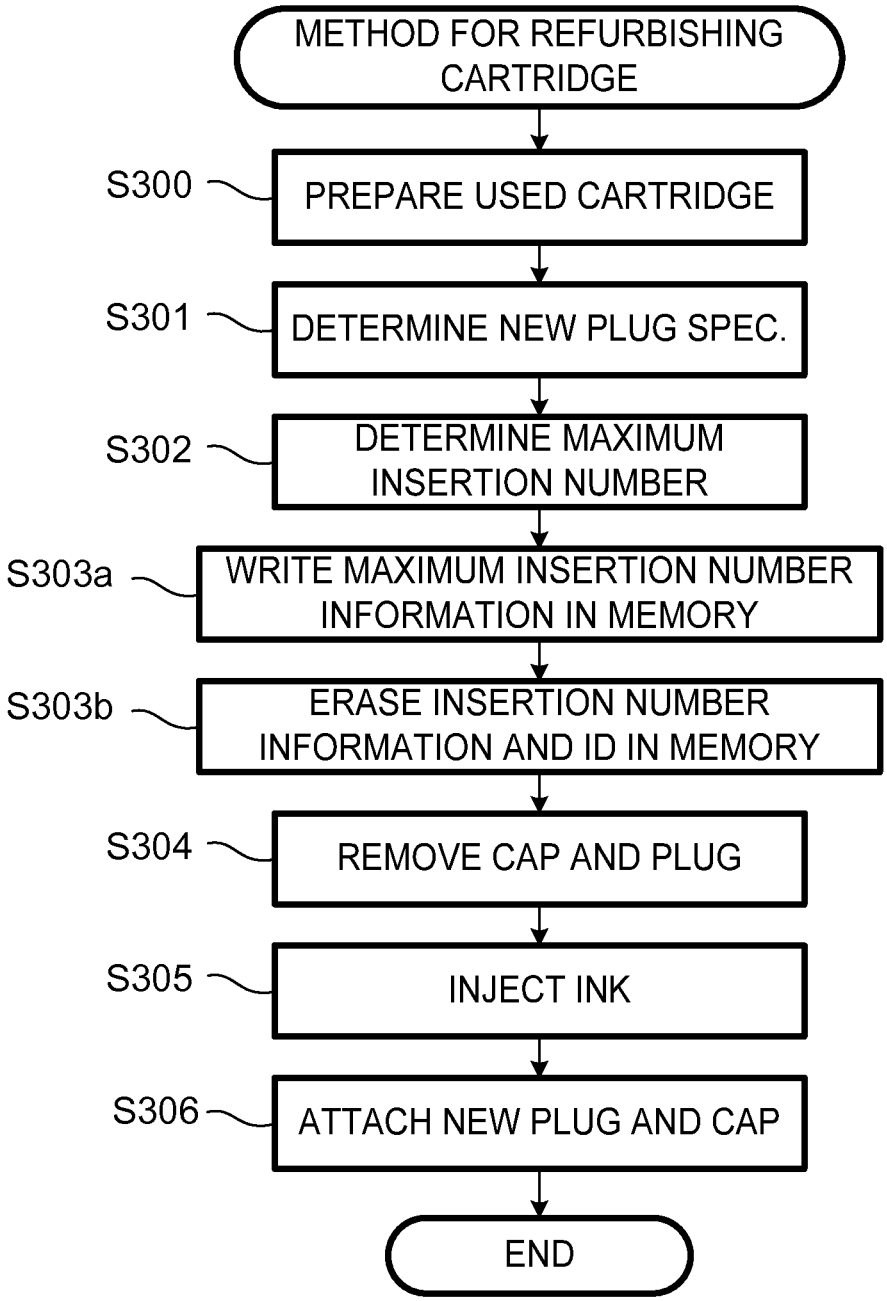
FIG. 27 is a flow chart illustrating a method for refurbishing the liquid cartridge according to various embodiments of the invention.

FIG. 27 shows an example of a method for refurbishing the liquid cartridge 40 according to the above-described embodiments of the invention. Each step in the method for refurbishing the liquid cartridge may be carried out by a refurbishing device or an operator. In this embodiment, all steps may be carried out by the refurbishing device. The refurbishing device may comprise an injector, a part attaching/detaching unit, a controller, and a display.

At Step S300, the refurbishing device may prepare a spent cartridge 40. Used cartridges are not limited to the ones to which the hollow tube 153 has been inserted into their respective plugs 50. After executing Step S300, at Step S301, the refurbishing device may determine the specifications of a new plug 50 to be newly attached to the liquid cartridge 40 prepared in S300, e.g., material, and thickness of the plug 50 relative to the insertion direction of the hollow tube 153. After Step S301, then a Step S302, the refurbishing device may determine the maximum insertion number adequate to the specifications determined in Step S301, in the same manner as described with respect to Step S202. After Step S302, then at Step S303*a*, the refurbishing device may cause the controller to write the maximum insertion number determined in Step S302 in the ROM area of the memory 141.

In S303*a*, the controller may overwrite the maximum insertion number stored in the memory 141. Alternatively, the controller may read the maximum insertion number stored in the memory 141 in advance. In this embodiment, when the maximum insertion number stored in the memory 141 is equal to the maximum insertion number determined in Step S302, the controller may not overwrite the maximum insertion number stored in the memory 141, and when the maximum insertion number stored in the memory 141 is not equal to the maximum insertion number determined in S302, the controller may overwrite the maximum insertion number stored in the memory 141.

After executing Step S303*a*, then at Step S303*b*, the refurbishing device may cause the controller to erase information regarding the insertion number information and printer IDs previously stored in the RAM area of the memory 141 prior to refurbishing. After executing Step S303*b*, then in Step S304, refurbishing device may actuate the part attaching/detaching unit to remove the plug 50 and the cap 46 from the opening 43*b*. After executing Step S304, then in Step S305, the refurbishing device may actuate the injector (not shown) to inject ink into the reservoir 42, similarly to as described in Step S205. After executing Step S305, then in Step S306, the refurbishing device may actuate the part attaching/detaching unit to attach a new plug 50 having the specifications determined in Step S301 and a cap 46 to the opening 43*b*. At this time, the cap 46 to be attached in Step S306 may be the same cap 46 as the cap 46 removed in Step S304, or it may be a new cap 46. After cap 46 is attached, refurbishing of the liquid cartridge 40 is completed.

In order to manufacture or refurbish the liquid cartridge 40 of the still yet another further embodiment, the above manufacturing method and refurbishing method may be read by replacing the plug 50 with the valve unit 750. In Steps S201 and S301, the manufacturing device and the refurbishing device may determine the specifications of the valve unit 750, especially for the valve seat 751, e.g., material and thickness of the valve seat 751 relative to the insertion direction of the hollow tube 153.

The controller 100 of the printer may execute controls shown in FIGS. 11 and 13 regardless of whether the liquid cartridge 40 is a refurbished liquid cartridge or a new, non-refurbished liquid cartridge. According to the above-described embodiments, the memory 141 of the liquid cartridge 40 stores the maximum insertion number information, e.g., as shown in FIGS. 12, 15, 19 and 20. In an embodiment of the invention, even when the plug 50 or the valve unit 750 is replaced with a new plug or valve unit, the user is not required to rewrite the maximum insertion number information. Thus, the potential for ink leakage may be reduced or eliminated by removing a need for the user to perform a burdensome operation.

According to the above-described embodiments, the memory 141 of the liquid cartridge 40 may further store the insertion number information, e.g., as shown in FIGS. 12, 15, 19 and 20. Thus, storing both of the maximum insertion number information and the insertion number information in the memory 141 of the liquid cartridge 40 may facilitate the controls by the controller 100 of the printer.

In the yet another embodiment to the still yet further embodiment, the memory 141 of the liquid cartridge 40 may store the maximum insertion number information in association with the number of IDs, e.g., as shown in FIGS. 15, 19 and 20. The position of the plug 50 into which the hollow tube 153 is inserted may be different according to different printers. As the number of positions of the plug 50 increases, and the number of holes formed in the plug 50 increases, the plug 50 may be broken by the walls of plug 50 being made thin by creating holes that are close together, thereby forming a wide hole from which ink may leak. As described above, storing the maximum insertion number information in association with the number of IDs in the memory 141 of the liquid cartridge 40 may reduce the potential for ink leakage effectively.

In FIGS. 15 and 19, the maximum insertion number associated with the number of IDs=3 may be set to zero. In other words, in the embodiments described above, the hollow tube 153 of the third printer may be disallowed from being inserted into the plug 50 of the liquid cartridge 40. In other embodiments of the invention not detailed here, this restriction may be removed.

In the further and yet further embodiments, the memory 141 of the liquid cartridge 40 may be configured to store the insertion numbers associated with the printer IDs in a one-to-one relationship, e.g., as shown in FIGS. 19 and 20. The position of the plug 50 into which the hollow tube 153 is inserted may be different according to different printers, even within the same type of printer. When the hollow tube 153 is inserted at a certain position of the plug 50 more times than other positions thereof, as compared with a case when the hollow tube 153 is inserted at plural positions of the plug 50 on average, the plug 50 may be broken at a thin wall between a hole at the certain position and an adjacent hole, and ink may be likely to leak. Thus, the potential for ink leakage from the plug 50 may be effectively reduced by storing the insertion number information associated with the printer IDs in the memory 141 of the liquid cartridge 40 and executing Steps S81 or S100 based on the insertion number information as described above.

According to the above-described embodiments, the liquid cartridge 40 may comprise the Hall device 71. Based on the signal from the Hall device 71, the controller 100 of the printer may determine a number of times the hollow tube 153 has been inserted into the plug 50 or the valve unit 750. According to the another and still another embodiments, when the controller 100 determines that the number representing the insertion number read from the memory 141 of the liquid cartridge 40 plus one (1) does not exceed the maximum insertion number read from the memory 141 of the liquid cartridge 40, the controller 100 causes the hollow tube 153 to move from the non-insertion position to the insertion position, e.g., as shown in Steps S23 and S26 of FIG. 13, and Steps S57 and S60 of FIG. 17. According to the yet further embodiment, when the controller 100 determines that the new insertion number "n" set in Steps S98 or S99 does not exceed the maximum insertion number identified in Step S96, the controller 100 may cause the hollow tube 153 to move from the non-insertion position to the insertion position, e.g., as shown in Steps S100 and S103 of FIG. 22. This may reduce the potential for ink leakage.

According to the still further and still yet further embodiments, the controller 100 may determine whether at least one of the insertion numbers "n", which may be set based on the insertion number associated with the current printer ID, and an insertion number associated with a printer ID that is not the current printer ID, e.g., an ID of a printer to which the ink cartridge 40 has been previously mounted, exceeds the maximum insertion number. This is shown, for example, in Step S81 of FIG. 23, and Step S100 of FIG. 24. This may reduce the potential for ink leakage.

In addition, other modifications of the above-described embodiments may be performed. For example, the still another to still yet further embodiments may be modified such that the total number of printer IDs, e.g., a total object number may be stored in the memory of the ink cartridge 40, e.g., as liquid ejecting device number data. Specifically, FIG. 28 shows one modification, which for exemplary purposes is a modification of FIG. 23. As shown in FIG. 28, the total number of printer IDs "3" may be stored in the memory of the ink cartridge. Specifically, the exemplary cartridge shown in FIG. 28 may show that the cartridge has been previously mounted to three printers, ID1, ID2, and ID3, as shown in the "total number of printer IDs" field, which in an embodiment of the invention may correspond to liquid ejecting device number data.

Figure 29:
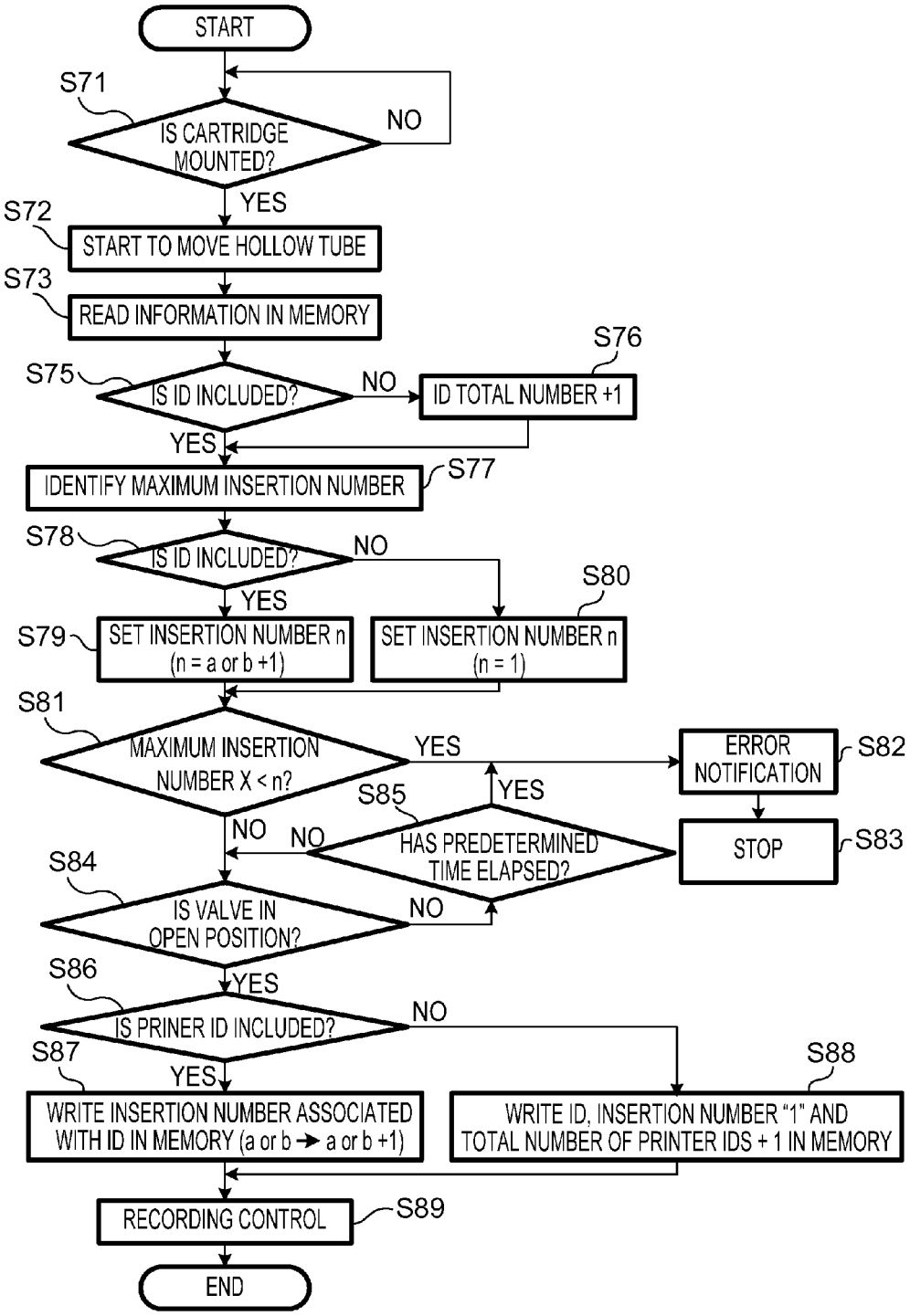
FIG. 29 is a flow chart illustrating operation of a controller of the printer according to the modified further embodiment of the invention.

FIG. 29 shows a modification of the embodiment shown in FIG. 18, to be carried out, for example, on a memory as shown in FIG. 28. The modification shown in FIG. 29 modifies the embodiment of FIG. 18 in two ways. First, Step S74 of FIG. 18 is removed from FIG. 29. Instead of executing Step S74, in the modification shown in FIG. 29, in Step S73, the controller of the printer may read the total number of printer IDs in the memory of the cartridge. Second, in Step S88 of FIG. 29, the controller may also write a number that is calculated by adding one to the total number of printer IDs read in Step S73, e.g., by incrementing the total number of printer IDs, and storing the updated number in the memory of the cartridge.

The above embodiments describe a magnetic sensor, e.g. the Hall device 71, as a sensor for detecting an object in a liquid path of a liquid cartridge, e.g. a liquid cartridge 40. In other embodiments, however, a magnetic sensor may be replaced with another type of sensor. For example, instead of the magnetic sensor, various types of sensors, e.g., a reflecting type photo sensor, a transparent type photo sensor, and a mechanical sensor for detecting an object in contact therewith, may be used.

The sensor may be configured to detect an object directly or indirectly. For example, the Hall device 71 is used for detecting the position of the valve 60 and the valve unit 750 in the above embodiments. When a hollow member (object) is inserted into a sealing member, e.g., the plug 50 disposed in the liquid path, at substantially the same time when the liquid cartridge is mounted in a mounting portion as shown in the still yet another further embodiment, a mount detection sensor for detecting that the liquid cartridge is mounted may be used. As the mount detection sensor, the mount detection switch 159 shown in the above embodiments, a photo sensor, and a mechanical sensor, e.g., for detecting that a protrusion formed on a surface of a cartridge case is pressed by a wall surface of the mount portion when the cartridge is mounted, and withdrawn toward the cartridge, for example may be used.

The components of the cartridge, e.g., the housing 41, the reservoir 42, the ink outlet tube 43, the plug 50, the valve 60, the sensor unit 70, the memory 141, and the valve unit 750, may be modified according to the specific needs of the application. Alternatively, different components may be added, and some of the above components or other components not listed here may be omitted while maintaining functionality of the liquid cartridge.

The insertion number information may be stored in a cartridge memory or a main unit memory. The maximum insertion number information may include the maximum insertion numbers by the number of positions, or the number of IDs, from 1 to n, where n is a natural number greater than or equal to 2, as the maximum insertion number information by the number of positions (IDs). Specifically, in the yet another embodiment to the still yet further embodiment, the maximum insertion number information also may comprise maximum insertion numbers associated with the number of positions or IDs from 1 to 3, but may include maximum insertion numbers associated with the number of positions or IDs from 1 to 2 or greater than or equal to 4. In addition, the maximum insertion numbers indicated in the maximum insertion number information by the number of positions (the number of IDs) are not limited to the numbers indicated in the above embodiments.

The maximum insertion number information and the insertion number information are not limited to the number of times, but may be information that may lead the number of times. Moreover, the maximum insertion number information and the insertion number information may be replaced with maximum detection number information and detection number information, respectively. In other words, the above embodiments show that the maximum insertion number information and the insertion number information are specified in view of the insertion of the hollow members into the open/close unit. However, the maximum insertion number information and the insertion number information also may be specified in view of detection of an object in the liquid path of the liquid cartridge by the sensor, in other embodiments of the invention.

A time to transmit and receive signals between the cartridge and the liquid ejecting device and a time to supply electric power from the liquid ejecting device to the cartridge are not limited to descriptions in the above embodiments, but may be changed as appropriate. The positions of the contact and the electric power input portion in the cartridge and the positions of the contact and the electric power output portion of the liquid ejecting device may be changed as appropriate in other embodiments.

A time when each section implements capability, e.g., a time when the reading section reads information stored in the cartridge memory, a time when the writing section writes in the cartridge memory, a time when the moving control section moves the hollow member, and a time when the determining section makes a determination may be changed as appropriate.

The liquid ejecting device may omit the notifying control section. For example, instead of notifying a user, in another embodiment of the invention, the liquid ejecting device may merely stop each component. The above embodiments show, but the disclosure is not limited to, as the mount detection section, the mount detection switch 159 that outputs an ON signal when the printer 1 and the liquid cartridge 40 are electrically connected. Instead, a photo sensor, a mechanical sensor or other sensor may be used. In another embodiment, this mount detection switch 159 may be omitted completely.

Movement of the hollow member from the non-insertion position to the insertion position may be performed by moving at least one of the hollow member and the liquid cartridge. The above-described embodiments, except for the still yet another further embodiment show, but the disclosure is not limited to, that the hollow tube 153 may be moved by the moving mechanism 155. In another embodiment of the invention, the liquid ejecting device may include a motor and gears to move the liquid cartridge 40 to the hollow tube 153 in a fixed position. In other embodiments, the liquid ejecting device may not include the moving control section as shown in the still yet another embodiment.

In each of the methods for manufacturing and refurbishing the cartridge, a step for determining specifications may be carried out after a step for determining the maximum insertion number. In other words, after the maximum insertion number is determined, the specification appropriate to the maximum insertion number may be determined and the open/close member having the specifications may be used.

A time to execute a step for determining the maximum insertion number and a step for writing, and a time to execute a step for injecting ink and a step for assembling components may be changed as appropriate. For example, the step for determining the maximum insertion number and the step for writing may be executed after the step for injecting ink and the step for assembling components.

In the method for refurbishing the cartridge, time to execute a replacement step, e.g., corresponding to Steps S304 and S306 in the above embodiment in which the sealing member is removed and replaced with a new one, and a time to execute the step for determining the maximum insertion number and the step for writing may be changed as appropriate in other embodiments. For example, in other embodiments, the step for determining the maximum insertion number and the step for writing may be executed after the replacement step. Alternatively, the step for determining the maximum insertion number and the step for writing may be executed before the replacement step in which the sealing member is removed and replaced with a new one.

The above embodiments show, but the disclosure is not limited to, that the hollow member has a pointed end like a needle. In addition, liquid stored in a liquid storing portion is not limited to ink. For example, a liquid for improving quality of image formed on a recording medium may be stored in the liquid storing portion in other embodiments, and a liquid for washing the transport belt may be stored in the liquid storing portion in other embodiments.

The number of liquid ejecting heads included in the liquid ejecting device is not limited to four. The liquid ejecting device may include one or more liquid ejecting heads in other embodiments. In addition, in other embodiments, the liquid ejecting device may be a line type device or a serial type device. Further, the liquid ejecting device is not limited to a printer. The liquid ejecting device may be a facsimile, a copier, a multifunction machine, or any other similar type of device, in other embodiments.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. A liquid cartridge comprising:

a liquid storing portion configured to store liquid therein;

a liquid path configured to be in fluid communication with the liquid storing portion;

a sealing member configured to selectively be penetrated and closed; and a storage comprising:

a first count storage area configured to store first count data corresponding to a number of times the sealing member has been penetrated at a first position; and a first position sealing data corresponding to a first number of times that is comparable to the first count data.

2. The liquid cartridge of claim 1, wherein when the sealing member is penetrated, the liquid storing portion is in fluid communication with an exterior of the liquid cartridge.

3. The liquid cartridge of claim 1, further comprising:

a sensor configured to output a signal corresponding to a position of an object in the liquid path.

4. The liquid cartridge of claim 1, further comprising:

a sensor configured to detect whether an object has penetrated the sealing member.

5. The liquid cartridge of claim 1, wherein the sealing member is configured to receive a particular object therethrough at the first position.

6. The liquid cartridge of claim 5, wherein the first count data corresponds to a number of times the sealing member has received the particular object therethrough.

7. The liquid cartridge of claim 1, wherein the sealing member is disposed in the liquid path.

8. The liquid cartridge of claim 7, wherein the sealing member is a continuously formed elastic member extending across the liquid path.

9. The liquid cartridge of claim 1, wherein the sealing member is configured to receive a particular object therethrough and the storage comprises:

a particular object area configured to store particular object data corresponding to the particular object.

10. The liquid cartridge of claim 9, wherein the particular object data is stored in the particular object area when the sealing member first receives the particular object.

11. The liquid cartridge of claim 9, wherein the particular object data uniquely identifies the particular object.

12. The liquid cartridge of claim 9, wherein the sealing member is configured to receive the particular object at the first position.

13. The liquid cartridge of claim 9, wherein the sealing member is further configured to receive a further object therethrough, and the storage further comprises:

a further object area configured to store further object data corresponding to the further object.

14. A liquid cartridge comprising:

a liquid storing portion configured to store liquid therein;

a liquid path configured to be in fluid communication with the liquid storing portion;

a sealing member configured to selectively be penetrated and closed; and a storage comprising:

a first count storage area configured to store first count data corresponding to a number of times the sealing member has been penetrated at a first position;

a first position sealing data corresponding to a first number of times that is comparable to the first count data;

a second count storage area configured to store second count data corresponding to a number of times the sealing member has been penetrated at a second position; and a second position sealing data corresponding to a second number that is comparable to each of the first count data and the second count data.

15. The liquid cartridge of claim 14, wherein the storage comprises:

a third count storage area configured to store third count data corresponding to a number of times the sealing member has been penetrated at a third position; and a third position sealing data corresponding to a third number that is comparable to each of the first count data, the second count data, and the third count data.

16. The liquid cartridge of claim 15, wherein the first position, the second position, and the third position are different.

17. The liquid cartridge of claim 15, wherein the first number is greater than each of the second number and the third number.

18. The liquid cartridge of claim 15, wherein the sealing member is configured to receive a third object therethrough at the third position.

19. The liquid cartridge of claim 18, wherein the third count data corresponds to a number of times the sealing member has received the third object therethrough.

20. The liquid cartridge of claim 14, wherein the sealing member is configured to receive a further object therethrough at the second position.

21. The liquid cartridge of claim 20, wherein the second count data corresponds to a number of times the sealing member has received the further object therethrough.

* * * * *